US007441650B2

(12) United States Patent
Tanaka et al.

(10) Patent No.: US 7,441,650 B2
(45) Date of Patent: Oct. 28, 2008

(54) OPHTHALMIC LENS STORAGE CONTAINER

(75) Inventors: Masayoshi Tanaka, Nagoya (JP); Seiichi Ichikawa, Kakamigahara (JP); Hiroyuki Oyama, Kakamigahara (JP)

(73) Assignee: Menicon Co., Ltd. (JP)

( * ) Notice: Subject to any disclaimer, the term of this patent is extended or adjusted under 35 U.S.C. 154(b) by 682 days.

(21) Appl. No.: 11/019,089

(22) Filed: Dec. 21, 2004

(65) Prior Publication Data

US 2005/0218012 A1 Oct. 6, 2005

Related U.S. Application Data

(63) Continuation-in-part of application No. 10/198,754, filed on Jul. 17, 2002, now Pat. No. 6,889,825.

(30) Foreign Application Priority Data

Jul. 17, 2001 (JP) ..... 2001-217080

(51) Int. Cl.
*A45C 11/04* (2006.01)

(52) U.S. Cl. ..... 206/5.1; 206/210; 220/359.1

(58) Field of Classification Search ..... 206/5.1, 206/210, 316.1, 461, 205, 467, 469, 470; 220/359.1, 359.2, 608, 669, DIG. 13; 134/901; D3/264

See application file for complete search history.

(56) References Cited

U.S. PATENT DOCUMENTS

| | | | |
|---|---|---|---|
| 4,605,142 | A | 8/1986 | Itoh et al. |
| 5,409,104 | A | 4/1995 | Lovell |
| 5,467,868 | A | 11/1995 | Abrams et al. |
| 5,609,246 | A | 3/1997 | Borghorst et al. |
| 5,704,468 | A | 1/1998 | Lust et al. |
| 5,722,536 | A | 3/1998 | Pierce et al. |
| 5,823,327 | A | 10/1998 | Wu et al. |
| 5,833,071 | A | 11/1998 | Ray |
| 5,983,608 | A | 11/1999 | Wu et al. |
| 6,050,398 | A | 4/2000 | Wilde et al. |

(Continued)

FOREIGN PATENT DOCUMENTS

| | | |
|---|---|---|
| EP | 0 223 581 A2 | 11/1986 |

(Continued)

*Primary Examiner*—Jila M. Mohandesi
*Assistant Examiner*—Steven A. Reynolds
(74) *Attorney, Agent, or Firm*—Rossi, Kimms & McDowell, LLP

(57) ABSTRACT

To provide an ophthalmic lens container of novel structure, whereby without the use of any special utensil, a liquid such as a preserving solution can be drained, while keeping an ophthalmic lens held in the container.

An ophthalmic lens container 210 includes a container body 212, wherein a cavity 224 has an opening inside face 228 of generally heart shape in a plane view. A constricted lower end of the lower section of the heart shape in the opening inside face has a circumferential radius of curvature: ra is smaller than a radius of curvature of a front face of the ophthalmic lens, and the two side portions of the heart shape in the opening inside surface 228 of the cavity 224 have the radius of curvature in the circumferential direction greater than the radius of curvature of the front face of the ophthalmic lens; while a diameter dimension of an inscribed circle in the opening of the cavity is greater than the outside diameter dimension of the ophthalmic lens.

14 Claims, 28 Drawing Sheets

U.S. PATENT DOCUMENTS

| | | | | |
|---|---|---|---|---|
| 6,082,533 | A | 7/2000 | Smith et al. | |
| 6,170,664 | B1 * | 1/2001 | Dar | 206/5.1 |
| 6,280,530 | B1 * | 8/2001 | Pankow | 134/6 |
| 6,474,465 | B1 * | 11/2002 | Jux | 206/5.1 |
| 2003/0029736 | A1 | 2/2003 | Phillips et al. | |

FOREIGN PATENT DOCUMENTS

| | | | |
|---|---|---|---|
| EP | 0 734 965 | A1 | 10/1996 |
| JP | 62-122969 | | 6/1987 |
| JP | 7-322911 | A | 12/1995 |
| JP | 9-23916 | A | 1/1997 |
| JP | 10-313928 | A | 12/1998 |
| WO | WO 94/24019 | A | 10/1994 |

* cited by examiner

OPHTHALMIC LENS STORAGE CONTAINER

CROSS-REFERENCE TO RELATED APPLICATION

This is a continuation in part application of application Ser. No. 10/198,754, filed Jul. 17, 2002 now U.S. Pat. No. 6,889,825.

INCORPORATED BY REFERENCE

The disclosure of Japanese Patent Application No. 2001-217080 filed on Jul. 17, 2001 including the specification, drawings and abstract is incorporated herein by reference in its entirety.

BACKGROUND OF THE INVENTION

1. Field of the Invention

The present invention relates generally to ophthalmic lens storage containers each having a lens storage portion for storing an ophthalmic lens such as a contact lens, more particularly to such an ophthalmic lens storage container having a novel structure to facilitate removal of the ophthalmic lens from the lens storage portion.

2. Description of the Related Art

A blister package is known as one type of a container for storing a contact lens. JP-A-7-322911, JP-A-9-23916, JP-A-10-313928 and U.S. Pat. No. 6,050,398 disclose known examples of the blister package that includes: a package body having a generally semi-spherical cavity and a flange extending radially outward around the periphery of the cavity; and a cover sheet formed of a plastic film, aluminum foil or the like. The cavity contains the contact lens and a preserving solution, and the cover sheet is stripably sealed to the flange in a sealing zone that extends around the periphery of the cavity, to thereby enclose the cavity.

The conventional blister package constructed as described above may suffer from a problem that the sealing zone formed in the flange of the package body is roughed once the cover sheet is stripped or peeled from the flange, being likely to cause undesirable generation of burrs or fuzz on the sealing zone extending around the periphery of the cavity. Generally, a user removes the lens from the cavity by sliding the Ilens up along the bottom surface and the open-end peripheral surface in this order, while pushing or gripping the lens by his or her fingers. Accordingly, the contact lens may come into contact with the burrs left on the sealing zone, and is likely to be damaged, e.g., occurrence of flaws or cracks on the surface of the lens, by the contact with the burrs. Especially, a contact lens of disposable type, which has relatively thin wall thickness and a low strength, is more likely to be damaged by the contact with the burrs, upon the removal of the lens from the lens storage container.

In a lens container of this type, it is sometimes necessary to pour off only the liquid contained in the cavity, while keeping the contact lens stored within the cavity. As a specific example, in some instances the contact lens provider, at some point up to the process where a contact lens and a preserving solution are stored in the cavity and sealed with a cover, may employ a procedure of placing the contact lens together with a treatment solution such as a cleaning solution in the cavity and subject it to appropriate treatment, after which the treatment solution only is poured off while leaving the contact lens, followed by injection of preserving solution. Also, in some instances, the user of the contact lens, after peeling off the cover to expose the cavity, may drain off only the preserving solution, and then remove the contact lens remaining in the cavity.

When a liquid contained in the cavity is to be drained off while keeping the contact lens within the cavity in this manner, there is a need to carry out the procedure easily and reliably. Therefore, it is desirable that without any special utensil, it be possible to detain the contact lens within the lens container when tilted, so that only the liquid can be drained from a particular location along the circumference at the rim of the cavity opening.

The lens containers of conventional design taught in the patent publications cited hereinabove have not been examined in this regard, as many of them employ a cavity inside shape that is a simply concave spherical shape. While improvements have been proposed, these have consisted simply in providing a slope so as to facilitate removal of the contact lens.

Accordingly, a problem to date has been that when liquid is poured off from the cavity as described above, the contact lens tends to be carried out together as well, making the procedure difficult.

SUMMARY OF THE INVENTION

It is therefore an object of the invention to provide an ophthalmic lens storage container having a novel structure that permits a damage free removal of the ophthalmic lens such as a contact lens, while facilitating the removal of the lens.

It is another object of the invention to provide an ophthalmic lens container of novel structure, whereby once a contact lens is stored immersed in a liquid, the liquid only may be drained off readily, while keeping the ophthalmic lens positioned therein.

The above and/or optional objects of this invention may be attained according to at least one of the following modes of the invention. Each of these modes of the invention is numbered like the appended claims and depending from the other mode or modes, where appropriate, to indicate possible combinations of elements or technical features of the invention. It is to be understood that the principle of the invention is not limited to these modes of the invention and combinations of the technical features, but may otherwise be recognized based on the teachings of the present invention disclosed in the entire specification and drawings or that may be recognized by those skilled in the art in the light of the present disclosure in its entirety.

(1) An ophthalmic lens storage container comprising: a container body including a lens storage portion having a cavity for storing the ophthalmic lens and a preserving solution, and a flange extending radially outward around an open-end peripheral portion of the cavity; and a cover sheet superposed on the container body for covering an opening of the cavity and being stripably sealed to the flange in a sealing zone that extends around the peripheral portion of the cavity over an entire circumference of the cavity, to thereby fluid-tightly seal the lens storage portion; wherein the flange of the container body includes an insulating portion located radially outward of the open-end peripheral portion of the cavity so as to extend circumferentially, the flange includes a shoulder surface that extends in a first direction opposite to a second direction along which the cavity is exposed; and wherein the sealing zone is located radially outward of the insulating portion of the flange.

The ophthalmic lens storage container constructed according to the present invention allows a lens user to remove the lens stored in the lens storage portion (e.g., a bottom surface of the cavity) by sliding up the lens along the bottom surface and the open-end peripheral surface in this order, while pushing or gripping the lens by his or her fingers, and to pick the lens up from the open-end peripheral portion and the flange by his or her fingers. In particular, the sealing zone in which the cover sheet is sealed to the flange is located radially outward of the insulating portion that is located radially outward of the open-end peripheral portion of the cavity, so that the sealing zone is effectively spaced apart from the cavity with the shoulder surface of the insulating portion interposed therebetween. This eliminates or reduces a possibility that the lens comes into contact with the sealing zone upon the removal of the lens from the lens storage portion, even if the sealing zone is roughed by stripping the cover sheet from the flange, and the burrs are undesirably generated on the sealing zone. That is, the ophthalmic lens storage container according to the present invention permits a removal of the contact lens with ease and safety while preventing the lens being damaged.

The cavity of the container body may be suitably designed and sized with no limitation to receive the lens and the sufficient quantity of sterile preserving solution to completely submerge the lens. The bottom surface of the cavity may be desirably shaped depending upon a specific conFIGuration, size and the like of an ophthalmic lens to be received in the cavity. For instance, the bottom surface of the cavity may have a concave ball-like shape as disclosed in U.S. Pat. No. 6,050,398, a flat plate-like shape as disclosed in JP-62-122969, a convex ball-like shape as disclosed in JP-A-10-313928, or the like. Preferably, the container body may be formed of synthetic resin materials having a high strength and a high tolerance, in view of the cost and efficiency in manufacturing the container body and easiness in handling the material. Examples of these materials are fluororesin, polyamide, polyacrylate, polyethylene, polyethylene terephthalate, poly vinyl chloride, non-crystalline polyolefin, polycarbonate, polysulfone, polybutylene terephthalate, polypropylene, polymethyl pentene, and the like. These materials are adopted solely or alternatively in a composite body or a laminar structure. Also, the cavity may have a variety of shapes in plane view, including a circular shape, a polygonal shape, an ellipsoidal shape, a heart shape, and the like. The container body may further be provided with an upright rib or a peripheral upright wall for the purpose of reinforcement, a hole or a cutout for assisting the user in lifting up the cover sheet from the flange, and an irregular surface for ensuring a non-slip grip of the container body by the user. The cover sheet may be a single film or alternatively a multi-layered film, and any film may be adopted as the cover sheet as long as the film is capable of being sealed to the container body by bonding, welding or other similar methods. Preferably, the cover sheet may be formed of a synthetic resin materials indicated above as the possible materials of the container body, a metallic material such as aluminum, or composite materials composed of these synthetic resin material(s) and metal(s).

(2) An ophthalmic lens storage container according to the above-indicated mode (1), wherein the flange of the container body further includes a lower surface spaced away from the opening of the cavity in the first direction, the lower surface serving for providing the sealing zone. According to this mode of the invention, the surface of the sealing zone is spaced away from the surface of the open-end peripheral portion of the cavity along which the lens is slid upon the removal of the lens, in the first direction, i.e., in the height direction. This arrangement is effective to avoid that the lens comes into contact with the burrs generated on the sealing zone when being removed from the lens storage portion. In addition, since the surface of the open-end peripheral portion of the cavity and the surface of the sealing zone is spaced apart from each other by the shoulder surface of the insulating portion in the height direction, the sealing zone can be located closer to the open-end peripheral portion of the cavity as seen in a plane view, with the separation between the sealing zone and the open-end peripheral portion of the cavity being maintained by the shoulder surface in the height direction. Thus, the container body can be made compact in size.

(3) An ophthalmic lens storage container according to the above-indicated mode (1) or (2), wherein the insulating portion is constituted by a groove open in a front surface of the flange in which the cavity is open, and the shoulder surface is constituted by an inner circumferential wall surface of the groove. This mode of the invention can provide the ophthalmic lens storage container according to the above-indicated modes (1) or (2) in an efficient manner. The sealing zone may be located (i) radially outward of the groove of the flange, or alternatively (ii) in the bottom surface of the groove. In the former case (i), the groove is placed between the surface of the open-end peripheral portion of the cavity and the surface of the sealing zone, thereby firmly assuring the separation between these two surfaces. In the latter case (ii), the sealing zone and the burrs generated on the sealing zone due to the cover sheet stripped from the flange can be completely held within the groove, thereby effectively preventing undesirable contact of the lens with the burrs upon the removal of the lens. In this respect, the inner circumferential wall surface of the groove is located adjacent to the cavity and serves as the shoulder surface.

According to any one of the above-described modes (1)-(3) of the invention, the insulating portion located radially outward of the open-end peripheral portion of the cavity needs to be formed in a portion in the flange, which is intended to be used for the removal of the lens at least, and needs not to be formed over an entire circumference of the cavity.

(5) An ophthalmic lens storage container according to any one of the above-indicated modes (1)-(4), wherein the open-end peripheral portion of the cavity extends circumferentially with an outwardly curved shape in cross section. According to this mode of the invention, since the open-end peripheral portion of the cavity has a smoothly curved surface without edge, thereby eliminating possibility that the lens is scratched by such an edge when being removed from the cavity.

(6) An ophthalmic lens storage container according to any one of the above-indicated modes (1)-(5), wherein an inner surface of the cavity includes a central portion and an open-end side portion that serves as a removal-guide surface whose radius of curvature is made different from that of the central portion. In this mode of the invention, the removal-guide surface is suitably adjusted, thereby facilitating removal of the lens sliding along the removal-guide surface. A specific conFIGuration of the removal-guide surface may be desirably determined by those skilled in the art while taking into account of efficiency in manufacturing the container body and a taste of users. In some instances, the removal-guide surface has an outwardly curved cross sectional shape in cross section that protrudes in the second direction, an inwardly curved shape that is recessed in the second direction or alternatively a gradient plane surface with a curvature of "0" that extends radially outwardly in the second direction. Described in detail, the removal-guide surface having the outwardly curved shape makes it easier to slide the lens along the removal-guide surface and pick up the lens from the removal-guide surface. The removal-guide surface having the inwardly curved cross-sectional shape with a radius of curvature that is smaller than a radius of curvature of the central portion of the cavity, allows the container body to be made compact in size without unduly enlargement of the lens storage portion, and allows the lens to be slid along the open-end peripheral portion of the cavity in a generally upright attitude, and to be readily removed from the lens storage portion. In the case where the principle of this mode (6) is adopted in combination with the principle of the aforesaid mode (5), the removal-guide surface may possibly be served as the open-end peripheral portion of the cavity, which extends circumferentially with the outwardly curved shape.

(7) An ophthalmic lens storage container according to the above-indicated mode (6), wherein the removal-guide surface consists of a plurality of segments having different radius of curvatures and being connected together in the second direction. This arrangement makes it possible to design the removal-guide surface with a great degree of freedom while taking into account of a user's taste and a material of the container body, as well as a size, kind, shape of the ophthalmic lens. These segments may smoothly join together along knots lying on tangents common to curves of these segments, or alternatively may discontinuously join together with junctions where no line tangents common to the curves of these segments. The removal-guide surface may comprise the plurality of segments that have different conFIGurations, e.g., an outwardly curved shape in cross section, a tapered gradient surface, and an inwardly curved shape in cross section, and that join together to form the removal-guide surface. Alternatively, the removal-guide surface may comprise the plurality of segments that have the same conFIGuration but have different radii of curvatures, and that join together to form the removal-guide surface.

According to any one of the aforesaid modes (5)-(7), the open-end peripheral portion of the cavity that extends circumferentially with an outwardly curved shape in cross section, and the removal-guide surface needs to be formed in a portion in the flange, which is intended to be used for the removal of the lens at least, and needs not to be formed over an entire circumference of the cavity. Further, the radius of curvature of the removal-guide surface may be constant over the entire circumference, or alternatively may desirably vary in the circumferential direction.

(9) An ophthalmic lens storage container according to any one of the above-indicated modes (1)-(8), wherein the insulating portion is located radially outward of the open-end peripheral portion of the cavity with a spacing in between, the spacing including a plane surface. According to this mode of the invention, the sealing zone can be widely spaced away from the open-end peripheral portion of the cavity, advantageously avoiding or minimizing undesirably contact of the lens with the sealing zone upon the removal of the lens from the container body.

(10) An ophthalmic lens storage container according to any one of the above-indicated modes (1)-(9), wherein at least one circumferential portion of the sealing zone protrudes radially outward with a beak-like shape to thereby provide a beak-like portion. In this mode of the invention, a stripping-off of the cover sheet begins at a tip end of the beak-like portion for reducing a stripping force required in opening the cover sheet, thus easing and smoothing the stripping-off of the cover sheet from the flange of the container body. Accordingly, a reaction in the container body against the stripping-off of the cover sheet is minimized, thus preventing that a relatively large amount of preserving solution is spilled from the opening of the cavity, and further facilitating removal of the lens. The conFIGuration of the sealing zone is not particularly limited but suitably determined taking into account of a plane shape of the opening of the cavity. Furthermore, the width dimension of the sealing zone may be generally constant over its entire circumference, or alternatively vary suitably in the circumferential direction for desirably adjusting stripping strength of the cover sheet.

In addition, stripping characteristics of the cover sheet can be adjusted by regulating the ratio B/L of the width dimension B of the beak-like portion to the length L from the base to the tip of the beak-like portion. Preferably, the ratio B/L is determined not to be larger than 5 ($B/L<5$) for assuring that the cover sheet can be opened smoothly. It is possible that the beak-like portion protrudes radially outwardly from the sealing zone with a gradient, but the beak-like portion preferably protrudes radially outwardly in the right angle.

(11) An ophthalmic lens storage container according to any one of the above-indicated modes (1)-(10), wherein at least one circumferential portion of the sealing zone extends radially outward to thereby provide a seal-retaining portion that allows the cover sheet, which is partially stripped from the flange to expose the cavity substantially entirely, to be retained in the flange. According to this mode of the invention, after the sealed cavity is opened, the cover sheet is still sealed at the seal retained portion and held in sealed to the container body, making it possible to handle the opened container body and the cover sheet as an integral member. Preferably, the dimension of the seal-retaining portion is sufficiently made larger in a direction perpendicular to a direction in which the cover sheet is stripped from the flange than other directions, thereby effectively preventing undesirably separation of the cover sheet from the container body upon the opening of the storage container. In the ophthalmic lens storage container provided with the seal-retaining portion according to the present mode of the invention, the cover sheet is desirably formed of a specific material so that the cover sheet partially stripped off from the flange to expose the cavity is held in its deformed state where the cover sheet is still secured at the seal-retaining portion in a generally upright attitude to keep the cavity open.

(12) An ophthalmic lens storage container according to the above-indicated mode (10), wherein the sealing zone extend radially outward to provide a seal-retaining portion at another circumferential portion that is opposed to the at least one circumferential portion where the beak-like portion is provided with the cavity interposed therebetween, the seal-retaining portion allows the cover sheet, which is partially stripped from the flange including the beak-like portion of the sealing zone to expose substantially entirely the cavity, to be retained in the flange. According to this mode of the invention, the beak-like portion permits a smooth start of the stripping-off of the cover sheet, while the seal-retaining portion effectively prevents undesirable separation of the cover sheet from the container body, for example when the cover sheet is stripped off abruptly from the container body. Accordingly, a reaction in the container body against the stripping-off of the cover sheet is further minimized or eliminated, thereby permitting a stable opening of the cavity.

(13) An ophthalmic lens storage container according to the above-indicated mode (12), wherein the sealing zone includes a pair of the beak-like portions formed at respective circumferential positions thereof opposed to each other with the cavity interposed therebetween, and one of the pair of beak-like portions serves as the seal-retaining portion. In this arrangement, the storage container can be opened from any sides of the opposite beak-like portions, leading to an improved practicability of the storage container. Moreover, the unopened beak-like portion can serve as the seal-retaining portion, thus establishing the effects of the seal-retaining portion, which were discussed above with respect to the aforesaid mode (12).

(14) An ophthalmic lens container comprising: (a) a container body including a lens storage portion having a cavity for storing an ophthalmic lens and a preserving solution, and a flange extending radially outward around an opening peripheral portion of the cavity and integrally formed with the lens storage portion; and a covering sheet superposed on the container body for covering an opening of the cavity, the covering sheet being strippably sealed around the entire circumference of the opening of the cavity to provide liquid tight closure to the lens storage portion, wherein (b) a bottom inside face of the cavity is of generally concave spherical shape, with a radius of curvature in a diametrical direction in a vertical cross section of the bottom inside face of the cavity is greater than a radius of curvature of a front face of the ophthalmic lens; (c) a radius of curvature in a circumferential direction of an inside surface of the opening of the cavity is varied along the circumferential direction, giving the opening inside surface of the cavity a planar shape generally resembling a heart shape; (d) in a constricted portion of a lower section of the heart shape in the opening inside surface of the cavity of generally heart shape, the radius of curvature in the circumferential direction is smaller than the radius of curvature of the front face of the ophthalmic lens; (e) in the two side portions of the heart shape in the opening inside surface of the cavity of generally heart shape, the radius of curvature in the circumferential direction is greater than the radius of curvature of the front face of the ophthalmic lens; and (f) a diameter dimension of an inscribed circle in the opening of the cavity is greater than the outside diameter dimension of the ophthalmic lens.

Turning first to an examination of a lens container of conventional design, the inside surface of the concave spherical face of the cavity for storing the ophthalmic lens has over the entirety thereof a radius of curvature that is greater than the radius of curvature: R of the convex spherical front face of the ophthalmic lens stored therein. It was discovered by the inventors that since the front face of an ophthalmic lens stored therein rests with one point at the center thereof constituting the point of contact with the inside face of the cavity, even when the lens container is tilted in order to drain out the liquid from the cavity, and since the ophthalmic lens has point-wise contact at only one point thereof with the inside surface of the cavity, it is therefore difficult to achieve an adequate level of effective frictional force or detaining action, thereby creating an extremely high risk of the ophthalmic lens being discharged from the cavity together with the liquid.

In the ophthalmic lens container of the present invention, the invention of which was based upon this discovery, the cavity in plan view has a very special shape, i.e. a non-circular, generally heart shape. By so doing, during the procedure of lowering the constricted portion at the lower end of the heart shape downwardly in order to incline the entire container and drain off the liquid, as the ophthalmic lens moves to the lower end of the heart shape, the front face of the ophthalmic lens, which has a greater radius of curvature than the radius of curvature in the circumferential direction of the inside face of lower end of the heart, comes into contact at two points along the circumference, with the inside face of the lower end of the heart shape of the cavity.

As a result, detaining force deriving from friction, attraction, etc. of the ophthalmic lens against the cavity inside face, as well as detaining force deriving from abutting force due to the ophthalmic lens being pinched from both sides in the circumferential direction, can be produced effectively so that the ophthalmic lens is easily detained on the cavity inside face, whereby without the use of any special utensil, the liquid only may be drained easily, while keeping the ophthalmic lens held in the container.

The invention can be implemented regardless of the type or material of the ophthalmic lens stored in the cavity, or of the liquid. The invention is implemented advantageously even in instances where the ophthalmic lens is accommodated in a generally floating state in a liquid, due to generally equal specific gravities of the ophthalmic lens and the liquid. However, when the container is inclined, the liquid will flow out first, and thus the liquid level will drip and a portion of the ophthalmic lens will project above the liquid surface. Since the ophthalmic lens comes into contact in this state with the inside surface of the cavity, abutting force of the ophthalmic lens against the cavity inside face will be assured by the weight of the ophthalmic lens.

Additionally, since the narrowing tip of the lower end of the heart is utilized in order to drain out the liquid therefrom, it is possible for the easily drained liquid to be drained out at a single, sufficiently narrow location along the entire circumference of the cavity opening. Thus, it is possible to define a fixed location for the liquid to drain from the cavity, making it possible to properly and consistently drain the liquid at the intended location, which also facilitates processes such as recovery of liquid drained from the container, or the like.

Additionally, since the large radius of curvature of the left and right portions at the two sides of the heart can be utilized to enable removal of the ophthalmic lens, even where the ophthalmic lens is removed by being slid along the cavity inside face, it will be possible to remove the ophthalmic lens in the same manner as with a lens container of conventional design, smoothly and with good operability under low frictional force and detaining force, due to the front face of the ophthalmic lens contacting the cavity inside face at one point only.

Additionally, by using in plan view a special shape, i.e. a heart shape, unlike the article disclosed in JP-A-7-322911 hereinabove, the cavity is symmetrical shaped on the left and right sides to either side of the line of incline during draining. Thus, added convenience is provided by the fact that, regardless of whether the user is right-handed or left handed, the procedure of draining the liquid and removing the ophthalmic lens can be carried out in the same manner.

Further, consumers of the contact lenses, for which the ophthalmic lens case pertaining to the invention is commonly used, include large numbers of the elderly and women. For such a stratum of consumers, through the use of a highly favorable heart motif for the entire shape of the article, while at the same time offering the excellent technical advantages described earlier, the invention affords notable features with regard to commercial value taking design and taste into consideration.

(15) An ophthalmic lens container is an ophthalmic lens container according to the above-indicated mode (14), wherein a circumferential radius of curvature: ra of a constricted lower end of the lower section of the heart shape in the opening peripheral portion of the cavity of generally heart shape is established so as to fulfill an equation: $0.2 \leqq ra/R \leqq 0.4$, with respect to a radius of curvature: R of the front face of the ophthalmic lens.

With the ophthalmic lens container according to this mode, the overall attractive design of the heart-shaped lens container can be maintained while providing, in the lower portion of the heart, a cavity inside face able to consistently give effective detaining force by means of contact of the ophthalmic lens at two points.

(16) An ophthalmic lens container according to the above-indicated modes (14) or (15) hereinabove, wherein in a circumferential radius of curvature: rb of the left and right side portions of the heart shape in the opening peripheral portion of the cavity of generally heart shape is established so as to fulfill an equation: $1.2 \leqq rb/R \leqq 2.0$, with respect to a radius of curvature: R of the front face of the ophthalmic lens.

With the ophthalmic lens container according to this mode, the overall attractive design of the heart-shaped lens container can be maintained while providing, in the left and right side portions of the heart, a cavity inside face that is more advantageously formed in terms of being able to easily and smoothly slide the ophthalmic lens in order to remove it.

(17) An ophthalmic lens container according to any one of the above-indicated modes (14)-(16), wherein a diametrical radius of curvature: rc in a vertical cross section of the bottom inside face of the cavity of generally heart shape is established so as to fulfill an equation: $1.2 \leqq rc/R \leqq 1.6$, with respect to a radius of curvature: R of the front face of the ophthalmic lens.

According to this mode, it is possible to advantageously realize, without excessively large size, a lens container wherein with the ophthalmic lens container resting therein in a generally horizontal state, an ophthalmic lens positioned on the bottom of the cavity undergoes no unnatural warping or the like due to localized abutment against the cavity inside face. Here, the cavity bottom face refers to a zone of depth generally equivalent to the axial height dimension of the ophthalmic lens from the deepest point of the cavity; by setting the radius of curvature: R of the cavity inside face of this deep zone in accordance with the equation above, an ophthalmic lens can be advantageously accommodated within the cavity.

(18) An ophthalmic lens container according to any one of the above-indicated modes (14)-(17), wherein the covering sheet sealed to the flange portion around the opening peripheral portion of the cavity has a pull tab extending further outwardly from the portion fixed to the flange portion, at a constricted lower end of the lower portion of the heart shape in the opening peripheral portion of the cavity of the heart shape, the pull tab being gripped in order to strip the covering sheet from the flange portion.

With the ophthalmic lens container according to this mode, since the initially stripped portion of the covering sheet constricts in conformity with the shape of the lower portion of the heart, the adhesive face extending in the direction orthogonal to the direction of stripping of the covering sheet is provided with small width dimension, so that the peel strength of the covering sheet may be held to a low level. Thus, ease of unsealing may be improved to make possible smooth unsealing, and shaking or other back action produced in the container body as the covering sheet is stripped when opening the cavity may be suppressed, so as the prevent the preserving solution from spilling out appreciably from the cavity opening, and making it easier to remove the lens.

(19) An ophthalmic lens container comprising a container body including a lens storage portion having a cavity for storing an ophthalmic lens and a preserving solution, and a flange extending radially outward around an opening peripheral portion of the cavity and integrally formed with the lens storage portion; and a covering sheet superposed on the container body for covering an opening of the cavity, the covering sheet being strippably sealed around the entire circumference of the opening of the cavity, to provide liquid tight closure to the lens storage portion, wherein a bottom inside face of the cavity is of generally concave spherical shape, with a radius of curvature in a diametrical direction in vertical cross section of the bottom inside face of the cavity being greater than a radius of curvature of a front face of the ophthalmic lens, while over at least a portion on a circumference of an inside face of the opening of the cavity, disposed is at least one upright curving portion whose radius of curvature in the diametrical direction in vertical cross section is smaller than a radius of curvature of a front face of the ophthalmic lens.

With the ophthalmic lens container according to this mode, with the ophthalmic lens container resting in a generally horizontal state so that the ophthalmic lens is stored positioned on the bottom of the cavity, the ophthalmic lens may be stored stably with no localized deformation or the like, within the bottom portion of the cavity of spherical concave shape having a radius of curvature greater than that of the front face of the ophthalmic lens. Meanwhile, in the event that the ophthalmic lens container is tilted in order to drain out the liquid only, when the ophthalmic lens moves together with the liquid towards the opening, the ophthalmic lens will come into abutment at two positions in the diametrical direction (vertical sectional direction) of the cavity at the inside face of the opening of the cavity, which has a radius of curvature smaller than that of the front face of the ophthalmic lens. As a result, detaining force deriving from friction, attraction, etc. of the ophthalmic lens against the cavity inside face, as well as detaining force deriving from abutting force due to the ophthalmic lens being pinched from both sides in the circumferential direction, can be produced effectively so that the ophthalmic lens is easily detained on the cavity inside face, whereby without the use of any special utensil, the liquid only may be drained easily, while keeping the ophthalmic lens held in the container.

(20) An ophthalmic lens container according to the above-indicated mode (19), wherein the ophthalmic lens container comprises a structure defined in any one of the above-indicated modes (14)-(18), and wherein two upright curving portions are provided at portions circumferentially opposed to each other with the constricted portion in the lower portion of the heart shape interposed therebetween, in the inside face of opening of the cavity.

With the ophthalmic lens container of structure according to this mode, when the ophthalmic lens container is inclined in order to drain the liquid from the constricted portion in the lower portion of the heart, the ophthalmic lens, moving together with the liquid into proximity with the opening of the ophthalmic lens container, comes into abutment at two circumferential locations thereof with the cavity inside face at the two sides of the latter in the circumferential direction to either side centered on the constricted portion in the lower portion of the heart, as well as coming into abutment in the vertical sectional direction (diametrical direction) at two positions in the upright curving portion. Thus, there is produced both detaining action of the ophthalmic lens within the cavity based on the design taught in the mode (14) hereinabove, and detaining action of the ophthalmic lens within the cavity based on the design taught in the mode (19) hereinabove, whereby outflow of the ophthalmic lens from the cavity may be prevented more effectively and consistently.

(21) An ophthalmic lens container according to any one of the above-indicated modes (14)-(20), wherein at least a portion in a circumferential direction of the opening peripheral portion of the cavity, over a zone of at least 2 mm in the depth direction from an opening peripheral portion of the cavity, is a sloping face having a slope angle of 45° or more with respect to a plane orthogonal to a center axis of the cavity in vertical cross section.

In the ophthalmic lens container of this mode, even when inclined by up to 45° when draining the liquid, the inside face of the opening peripheral portion of the cavity will be maintained in either a horizontal attitude or a sloping attitude moving upward from the bottom towards the opening. Thus, at the opening peripheral portion which is still maintained in a generally horizontal attitude or upward-facing attitude while most of the liquid is being drained from the cavity, the ophthalmic lens can be kept inside the cavity, just as if it were trapped therein. Accordingly, in conjunction with the detaining action produced by abutment at two points in the circumferential direction or two points in the vertical sectional direction as described above, even if the ophthalmic lens should happen to slide into proximity with the cavity opening, it will be detained by the cavity opening, making it possible to prevent it from being carried out.

In this mode, since the ophthalmic lens can be positively detained and held by being trapped by the opening peripheral portion of the cavity, after the liquid has been drained, the ophthalmic lens can be held with a portion thereof projecting outwardly beyond the cavity opening. By having a portion of the ophthalmic lens project outwardly beyond the cavity opening in this way, when removing the ophthalmic lens from the cavity, it can be picked up without having to slide the ophthalmic lens along the cavity inside face, thereby making is possible to remove the ophthalmic lens from the case container more safely, while avoiding damage to it.

(22) An ophthalmic lens container according to any one of the above-indicated modes (14)-(21), wherein a circular recessed portion having a radius of curvature smaller than a radius of curvature of the ophthalmic lens is formed at a location in an approximate center of the bottom inside face situated at the deepest portion of the cavity, the circular recessed portion opening into the bottom inside face of the cavity via an opening diameter of ϕ1 mm −5 mm.

In the ophthalmic lens container of this mode, with the ophthalmic lens container resting generally on the horizontal so that the ophthalmic lens is positions in the deepest portion of the cavity, the center portion of the front face of the ophthalmic lens is supported in linewise contact about the circumference of a circle against the opening peripheral portion of the circular recessed portion. By so doing, abutment of the front face of the ophthalmic lens at a single point in the center thereof against the cavity inside face while at rest is avoided, and the ophthalmic lens can be support more stably within the container. Additionally, as compared to the case where the ophthalmic lens is supported in pointwise contact at a single point within the container, any outside forces acting on the lens are dispersed by means of linewise contact, and in particular since the ophthalmic lens is supported through in a circular ringwise abutment about the approximate center axis thereof, external force acting on the ophthalmic lens can be made generally uniform about the center axis thereof, thereby avoiding strain and other deformation, and keeping the ophthalmic lens supported in good condition within the cavity.

(23) An ophthalmic lens container according to any one of the above-indicated modes (14)-(21), wherein a generally plane, circular flat portion extending in an axis-perpendicular direction by an outside diameter dimension of ϕ1 mm −3 mm is formed at a location in an approximate center of the bottom inside face located in the deepest portion of the cavity.

In the ophthalmic lens container of this mode, even with the ophthalmic lens container stored at rest generally on the horizontal, the contact location of the front face of the ophthalmic lens stored in the cavity against the cavity inside face is readily displaced on the circular flat portion by the application of a low level of external force or the like. Thus, it becomes possible to prevent the ophthalmic lens from continuous contact with a particular region of the cavity for an extended period.

(24) An ophthalmic lens container according to any one of the above-indicated modes (14)-(23), wherein a surface roughness of the inside face of the cavity has a maximum height: Ry value such that Ry≦5 μm.

In the ophthalmic lens container of this mode, the inside face of the container against which the front face of the ophthalmic lens comes into contact is a relatively smooth face, reducing damage to the ophthalmic lens. That is, where, for example, the user when removing the ophthalmic lens from the cavity should happen to slide the ophthalmic lens along the inside face of the cavity while pressing it with a finger, it will nevertheless be possible to effectively prevent damage to the ophthalmic lens surface due to rubbing against the cavity inside face, as well as to remove the ophthalmic lens smoothly from the relatively smooth cavity inside face.

If the cavity inside face is made smooth, while it would be difficult to retain the ophthalmic lens within the cavity while draining off the liquid only from the cavity, in the present invention, the specially shaped cavity inside face described above is employed. Therefore, the ophthalmic lens may be effectively detained against the cavity inside face at at least two points, so that while making it possible to detain the ophthalmic lens within the cavity when draining the liquid. It is also made possible to easily remove the ophthalmic lens for use, by sliding it along the smooth cavity inside face.

(25) An ophthalmic lens container according to any one of the above-mentioned modes (14)-(23), wherein the inside face of the cavity has a surface roughness finer than 800 grid sandpaper.

In the ophthalmic lens container of this mode, there is afforded a working effect similar to that of the mode (24) described above.

In the mode (24) or (25) of the invention, in preferred practice, surface roughness of the cavity inside face will have some level of roughness, rather than being excessively smooth. With this arrangement, it becomes possible to achieve a number of advantages, for example, to readily achieve force detaining the ophthalmic lens within the cavity when draining off the liquid, or to be able to avoid the phenomenon of attracting of the ophthalmic lens onto the cavity inside face as can occur with particular combinations of lens materials and case materials.

Specifically, in preferred practice the surface of the cavity inside face will have wrinkle-like irregularities, the roughness thereof, when measured using the "Form Talysurf" by "Taylor Hobson Ltd." on the mold user to produce the cavity inside face, having an average value of 1.0 μm or above, more preferably 2.0 μm or above, in either the horizontal direction or vertical direction.

(26) An ophthalmic lens container according to any one of the above-indicated modes (14)-(25), wherein the container body is fabricated from a transparent resin material having visible light transmissivity of 80% or more in the axial direction of the cavity in the lens storage portion.

In the ophthalmic lens container of this mode, at some stage in the production process of an ophthalmic lens container product having an ophthalmic lens stored therein, or at some point prior to shipping thereof or subsequent to shipping thereof, for example, it is possible to carry out inspection to verify that the ophthalmic lens is present, whether there are defects, and so on, doing so from the outside through the container either visually or with suitable optical means.

This mode is particularly favorable used in combination with the above-indicated modes (24) and (25). By so doing, since surface roughness of the cavity inside face is smoothed while preventing the ophthalmic lens from escaping during draining of the liquid, the level of scattering of light rays by the cavity inside face is reduced. That is, according to this mode, in an ophthalmic lens container according to the invention, that effectively presents the ophthalmic lens from escaping, it is possible to avoid hindering the ophthalmic lens escape-preventive function, while also facilitating verification of the presence of the ophthalmic lens from the outside.

This mode (26) is also favorable used in combination with the above-indicated mode (22) or (23). Particularly in a mode combining the ninth mode with this thirteenth mode, by continuing to retain the ophthalmic lens at a stable position on the bottom portion through contact with the opening peripheral portion of the circular recessed portion, examination or inspection of the ophthalmic lens with a higher level of accuracy is possible. In a combining the mode (23) with this mode (26), since it is possible to readily induce the ophthalmic lens stored in the cavity to undergo displacement on the circular flat portion by means of displacement or shaking by applying a low level of external force to the ophthalmic lens container, for example, in instances where the presence of or defects in an ophthalmic lens are difficult to ascertain optically, the ophthalmic lens may be displaced in order to enable the ascertainment procedure to be carried out easily and accurately.

(27) An ophthalmic lens container according to any one of the above-indicated modes (14)-(26), wherein in the flange portion, at a location spaced apart by a predetermined distance radially outwardly from the opening peripheral portion of the cavity, a shoulder face that extends bending upward in a same direction as an opening direction of the cavity or axially downward in a direction opposite the opening direction of the cavity is formed continuously around an entire circumference in the circumferential direction to constitute an edge cutting portion, and a sealing face of the covering sheet is disposed at a location to an outer peripheral side of the edge cutting portion.

In the ophthalmic lens container of this mode, the ophthalmic lens is removed from the cavity serving as the lens storage portion, for example, by sliding the ophthalmic lens towards the opening peripheral portion of the cavity while pressing down on it from above with a finger, and picking it up from the cavity opening to remove it. Here, since the sealing face of the container body and covering sheet is disposed to the outer peripheral side of the edge cutting portion which in turn is located the outer peripheral side of the opening peripheral portion of the cavity, with the sealing face spaced apart from the opening peripheral portion of the cavity and the shoulder portion of the edge cutting portion is situated therebetween, when removing the ophthalmic lens, even if burrs or the like consisting of adhesive, the ophthalmic lens container, the covering sheet, or the like should occur resulting in roughness on the sealing face on the container body side, contact of the lens with the sealing face on the container body side is avoided. Thus, damage to the ophthalmic lens caused by interference by burrs during lens removal can be prevented, so that removal of the ophthalmic lens from the container body can be carried out more easily and safely. In this mode, in preferred practice, the edge cutting portion will be formed by shoulder face that extends bending downward in the direction opposite the opening direction of the cavity, in order to avoid contact of the lens with burrs or the like during removal.

BRIEF DESCRIPTION OF THE DRAWINGS

In order to further clarify the present invention, there will be described preferred embodiments of the present invention with reference to the following drawings.

DETAILED DESCRIPTION OF PREFERRED EMBODIMENTS

Figure 1:
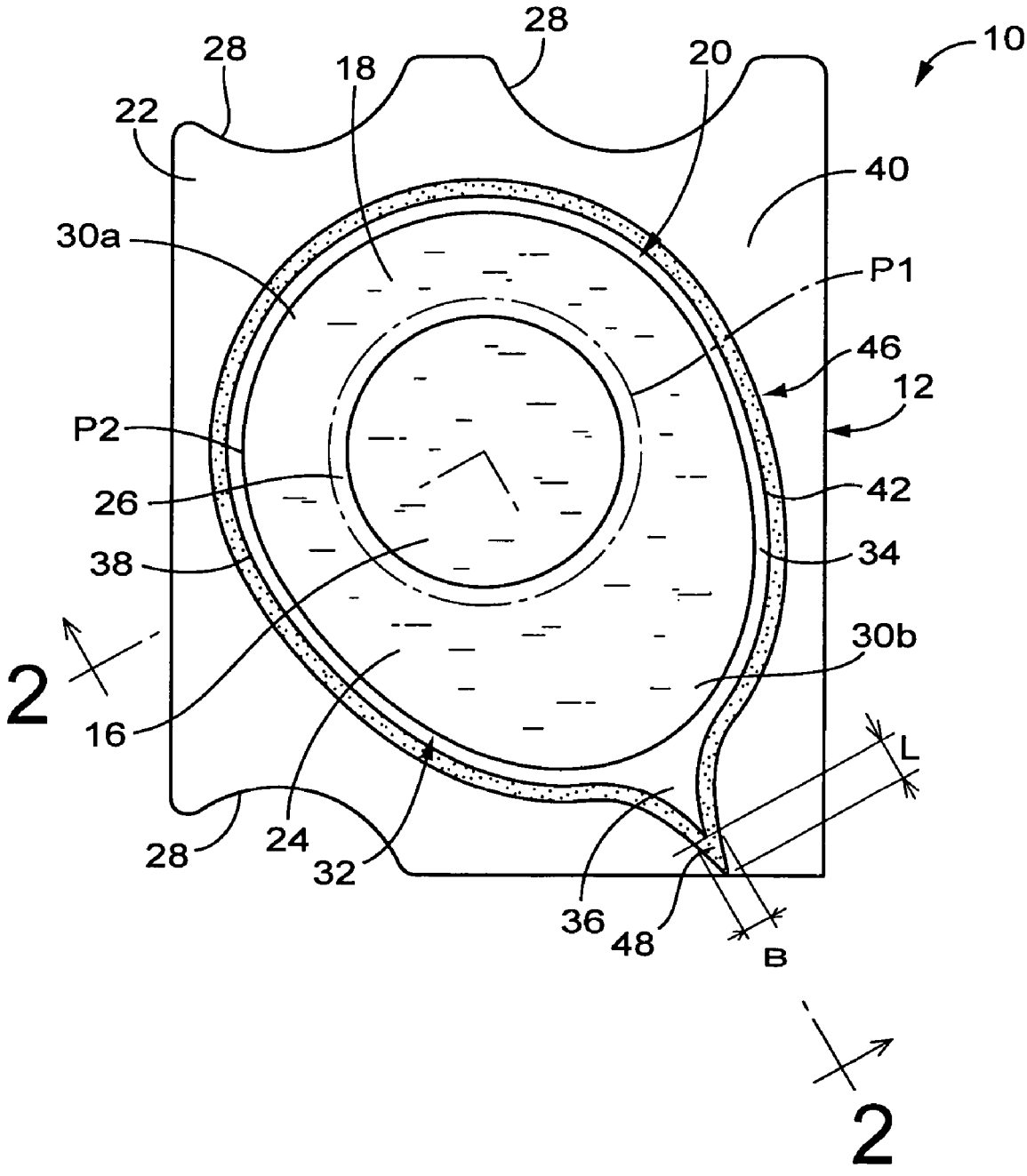
FIG. 1 is a top plane view of an ophthalmic lens storage container in the form of a blister package according to a first embodiment of the present invention, where a cover sheet of the blister package is not secured.
Figure 2:
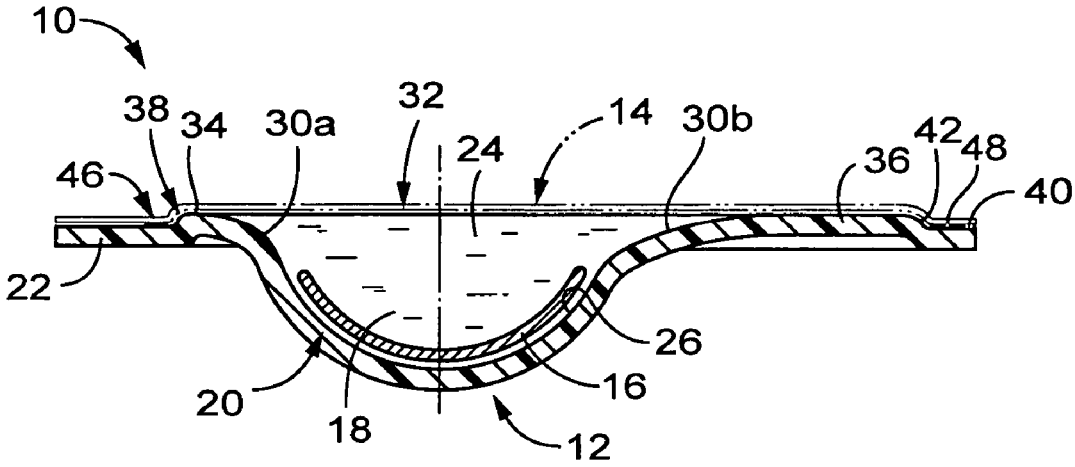
FIG. 2 is a cross sectional view taken along line 2-2 of FIG. 1.

Referring first to FIGS. 1 and 2, a blister package 10 is shown as a first embodiment of the ophthalmic lens storage container of the present invention. The blister package 10 includes a container body 12 and a cover sheet 14. The container body 12 stores a contact lens 16 and a preserving solution 18. The cover sheet 14 is stripably sealed to the container body 12, whereby the contact lens 16 is fluid-tightly enclosed in the container body 12 and can be removed from the container body 12 as needed.

The container body 12 includes a lens storage portion 20 surrounded by a flange 22, and is formed of a synthetic resin material such as polypropylene and polyethylene by injection molding or the like. The lens storage portion 20 has a semi-spherical shell shape that is made somewhat flat in a thickness direction, and a cavity 24 with a round bottom is formed within the lens storage portion 20. An inner surface of a bottom portion of the lens storage portion 20, i.e., an inner surface of a central portion of the cavity 24 is hereinafter referred to as a bottom surface 26. This bottom surface 26 is a spherical concave surface whose radius of curvature RI is substantially made constant (see FIG. 3). The flange 22 has a thin-walled rectangular flat plate shape, and is integrally formed at an open-end peripheral portion of the cavity 24 so as to extend outwardly in a radial direction perpendicular to an axial or vertical direction as seen in FIG. 2. Hereinafter, the axially or vertically upward direction is referred to as a "second direction" along which the cavity 24 is open, and the axially or vertically downward direction is referred to as a "first direction in which a shoulder surface 42, which will be described later, extends. Also, the flange 22 is provided in its peripheral portion with three cutouts 28 different in size. Each cutout 28 has a generally semi-circular shape as seen in FIG. 1 to help a user grip the container body 12 by his or her fingers.

As shown in FIGS. 1 and 2, the lens storage portion 20 serves for storing the contact lens 16 and the preserving solution 18, and the cavity 24 is substantially fully filled with the preserving solution 18 that is enough to completely submerge the contact lens 16. The kinds and materials of the contact lens 16 and the preserving solution 18 are not particularly limited. In the present embodiment, for example, the contact lens 16 may be a soft hydrophilic contact lens made of copolymers of hydroxyethle methacrylete (HEMA), and the preserving solution 18 may be a solution capable of preventing dehydration and maintaining the contact lens 16 in a ready to wear condition, and specific examples are a sterile aqueous solution and an isotonic saline solution.

A guide surface 30 for helping removal of the contact lens 16 is formed in the open-end peripheral portion of the cavity 24 that constitutes the outer peripheral portion of the lens storage portion 20. This guide surface 30 is smoothly connected to the bottom surface 26, and extends circumferentially with an outwardly curved or convex shape in cross section that protrudes outwardly in the second direction along which the cavity 24 is open.

Figure 3:
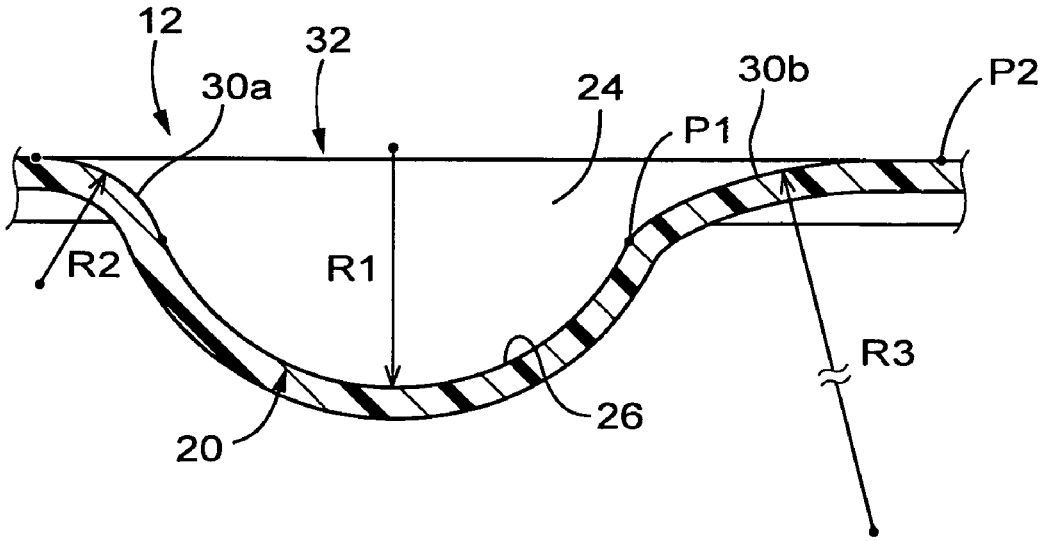
FIG. 3 is a fragmentally enlarged view in cross section of a principle part of the blister package of FIG. 1.
Figure 4:
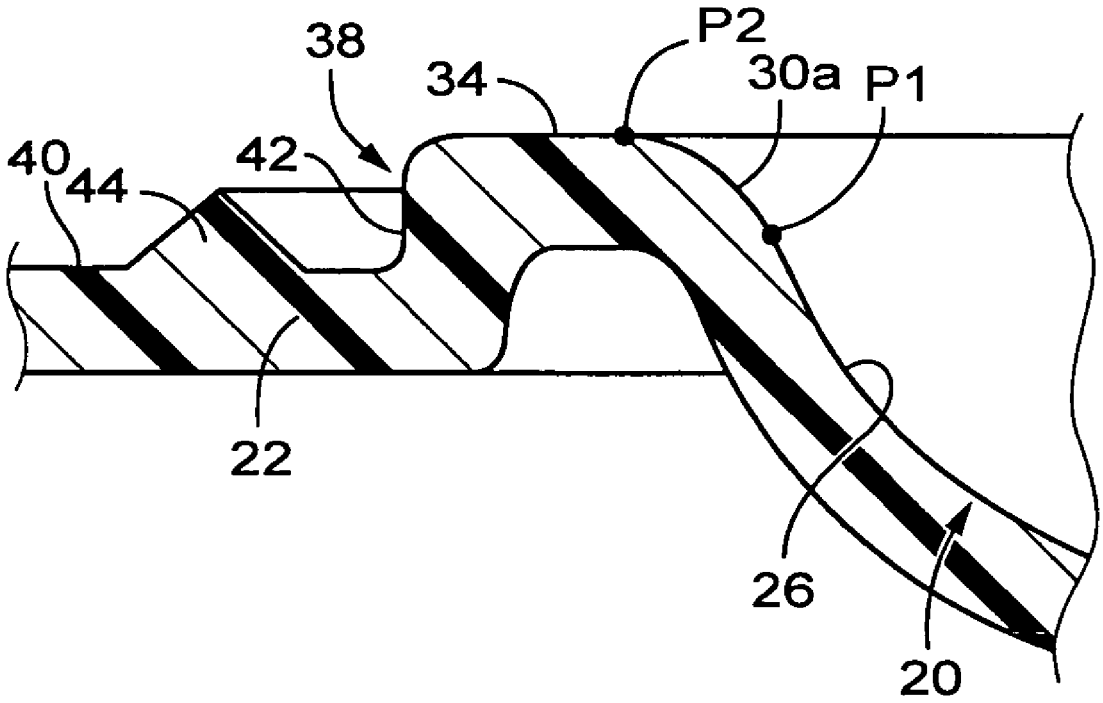
FIG. 4 is a fragmentally enlarged cross sectional view for explaining one step of manufacturing a container body of the blister package of FIG. 1.

The radius of curvature of the removal guide surface 30 varies in the circumferential direction, as shown in FIGS. 1 and 3. Described in detail, the guide surface 30 consists of guide surface halves 30*a*, 30*b*. The guide surface half 30*a* is contiguous to one semi spherical portion (left oblique upper part as seen in FIG. 1) of the bottom surface 26, and has a radius of curvature R2 that is made substantially constant over about a half of the circumference thereof. The guide surface half 30*b*, on the other hand, is contiguous to the other semi spherical portions (right oblique lower part as seen in FIG. 1) of the bottom surface 26, and has a radius of curvature R3 that is made larger than the radius of curvature R2 of the guide surface half 30*a*. The bottom surface 26 with the radius of curvature RI and the guide surface half 30*a* with the radius of curvature R2 join together along knots P1 lying on tangents common to these surfaces 26, 30*a*, while the bottom surface 26 with the radius of curvature R1 and the guide surface half 30*b* with the radius of curvature R3 join together along knots P1 lying on tangents common to these surfaces 26, 30*b*. In this arrangement, an amount of extension of the guide surface 30 in the radially outward direction is made large at one circumferential position located in the right-hand lower portion as seen in FIG. 1, whereby the curve of the guide surface half 30*b* at the circumferential position is made more moderate or smooth than the curve of the guide surface half 30*a*. In the plane view shown in FIG. 1, the outer peripheral portion of the guide surface 30, which defines an opening 32 of the cavity 24, has an egg-like shape where the right-hand lower portion extends radially outwardly. That is, the opening 32 of the cavity 24 has the egg-like shape where a first circumferential portion (located in the right-hand lower end portion as seen in FIG. 1) opposed to a second circumferential portion (located in the left-hand upper end portion as seen in FIG. 1) in a major axis direction has a radius of curvature that is made smaller than that of the second circumferential portion. It should be appreciated that the flange 22 has a generally rectangular shape, while the guide surface 30*b* functioning as an intended lens removal portion is approximately directed to a diagonal direction of the flange 22, whereby the guide surface 30 can be effectively extended in the generally diagonal direction, while avoiding an undue enlargement of the size of the container body 12.

The guide surface 30 is surrounded by a plane surface 34. The plane surface 34 extends in a direction perpendicular to the second direction along which the cavity 24 is open, and is formed continuously to surround the opening 32 of the cavity 24 over the entire circumference. The curves of the guide surface halves 30*a*, 30*b* with the respective radius of curvatures R2, R3, and the plane surface 34 join together at knots P2 lying on lines tangent to the curves and lying on the plane surface 34. The width dimension of the plane surface 34 is made generally constant over its entire circumference.

The plane surface 34 includes an acute projection 36 formed on the side of the first circumferential portion of the opening 32 of the cavity 24 where the radius of curvature is made smaller in plane view to be extended outwardly.

Further, a lower surface 40 is disposed radially outward of the plane surface 34 via a shoulder portion 38 functioning as an insulating portion. The shoulder portion 38 includes a shoulder surface 42 that is contiguous-to the outer peripheral portion of the plane surface 34 and extends contiguously to surround the plane surface 34 over its entire circumference. The shoulder surface 42 extends in the above-mentioned first direction opposite to the second direction along which the cavity 24 is open, to be connected to the lower surface 40. The lower surface 40 extends in the radially outward direction perpendicular to the first and second directions, and is formed continuously over its entire circumference. The outer peripheral portion of the lower surface 40 serves as an outer peripheral portion of the flange 22. That is, the lower surface 40 is located downward of the plane surface 34 by the height dimension of the shoulder surface 42 in the axial or vertical direction as seen in FIG. 1, and radially outward of the plane surface 34 in the flange 22. As is understood from the afore the description, the plane surface 34, the lower surface 40 and the shoulder portion 38 cooperate to define the flange 22 of the container body 12.

On the other hand, the cover sheet 14 may be formed of a laminate sheet made of a composite material composed of an aluminum foil and a synthetic resin material, by way of example, and has an outside profile conforming to a shape of the upper surface of the container body 12. The cover sheet 14 may be stripably sealed to the container body 12 by heat-sealing, for instance. Described in detail, a projection 44 is integrally formed in advance on the lower surface 40 of the container body 12 for use in sealing the cover sheet 14 to the flange 22 by heat-sealing. This projection 44 is disposed on the lower surface 40 and located near the shoulder surface 42, while extending circumferentially continuously to surround the opening 32 of the cavity 24 over the entire circumference with a generally constant triangular shape in cross section and a generally constant width dimension. For securing the cover sheet 14 to the container body 12, the cover sheet 14 is superposed on the tip end face of the projection 44, and then the surface of the cover sheet 14 is pushed onto the container body 12 by means of a suitably heat application member for use in welding, whereby the cover sheet 14 is secured to the container body 12 by means of the projection 44 that is mashed and fusion-welded between the cover sheet 14 and the container body 12. In the present embodiment, the projection 44 is mashed and fusion-welded in the process of heat-sealing to form a sealing zone 46 right round the shoulder portion 38 at which the cover sheet 14 is sealed to the container body 12, and the sealing zone 46 can be separated from the plane surface 34 in the axial or vertical direction as seen in FIG. 1. That is, the sealing zone 46 is substantially insulated from the guide surface 30 and the plane surface 34, in the present embodiment.

The sealing zone 46 includes a beak-like portion 48 which is located radially outward of the acute projection 36 of the plane surface 34, and which has an acute projection shape. The beak-like portion 48 may have a variety of shapes and sizes, but not be limited specifically. Preferably, the shape and size of the beak-like portion 48 are suitably changed by adjusting the ratio of B/L of the width dimension B at the base of the beak-like portion 48 to the length L from the base to the tip of the beak-like portion 48, in order to make it easy to strip off the cover sheet 14. More preferably, the ratio B/L is determined to be smaller than 5 ($B/L \leqq 5$) for assuring excellent performance in stripping off the cover sheet 14. In the present embodiment, for example, the ratio B/L is made smaller than 1 ($B/L \leqq 1$).

As indicated by two-dot chain line in FIG. 2, the cover sheet 14 is sealed to the container body 12 with its central portion being raised in the vertically upward or in the second direction by means of the shoulder portion 38, as a result of the heat-sealing where the cover sheet 14 is superposed on the upper surface of the container body 12 and secured to the welded projection 44. Thus, the cover sheet 14 fluid-tightly seals the opening 32 of the cavity 24. In this respect, the container body 12 stores the contact lens 16 and the preserving solution 18 in advance, and then the cover sheet 14 is sealed to the flange of the container body 12, thereby providing the blister package 10 according to the present invention. The cover sheet 14 may be printed or affixed with desired information or design as needed.

In the blister package 10 constructed according to the present embodiment, the sealing zone 46 at which the cover sheet 14 is sealed to the flange of the container body 12 is located axially or vertically downward of the plane surface 34 as seen in FIG. 2 by the shoulder portion 38 interposed therebetween in the vertical direction. This makes it possible to eliminating or reducing a possible problem that the lens comes into contact with the sealing zone 46 when being removed from the lens storage portion, even if the sealing zone 46 is roughed by stripping the cover sheet 14 from the flange and burrs are undesirably generated on the sealing zone 46. Therefore, the contact lens 16 is less likely to be damaged when being removed from the lens storage portion 20, thereby assuring an excellent removal of the contact lens 16 from the container body 12.

In the present embodiment, the guide surface 30 gives the convex or outwardly curved surface at the open-end peripheral portion of the cavity 24, and no edge is formed on the open-end peripheral portion of the cavity 24, thereby eliminating possible damage of the contact lens 16 caused by being scratched by the open-end peripheral portion of the cavity 24.

Moreover, the guide surface 30 is smoothly connected to the bottom surface 26 of the cavity 24 and the plane surface 34 at the all knots P1, P2 with a smooth or junctionless curve. This arrangement allows the contact lens 16 to be smoothly slid up along the bottom surface 26, the guide surface 30 and the plane surface 34 in this order.

In the present embodiment, only the first circumferential portion of the opening of the cavity 24 (located in the right-hand lower end portion as seen in FIG. 1) is intended to be used for the removal of the lens, namely is designated as a intended lens removal portion, so that the radius of curvature of the guide surface 30 can be made smaller at the other circumferential portion of the opening of the cavity 24, thereby making the entire size of the opening 32 of the cavity 24 in the plane surface compact or small. On the other hand, the radius of curvature of the guide surface 30 is made larger at the first circumferential portion, whereby the contact lens 16 can be readily removed from the cavity 24 by sliding the contact lens 16 up the guide surface 30.

Since the plane surface 34 having a wide width is interposed between the guide surface half 30*b* and the shoulder portion 38, the plane surface 34 functions to prevent the contact lens 16 slid along the guide surface 30 being dropped downward from the outer peripheral portion of the guide surface 30 (or the shoulder portion 38) to the lower surface 40, thereby assuring an excellent removal of the contact lens 16 from the container body 12. Further, the plane surface 34 allows the cover sheet 14 to be held in close contact with the plane surface 34 with high stability, whereby the cover sheet 14 can fluid-tightly seal the opening 32 of the cavity 24 with excellent fluid-tight sealing in between.

Yet further, the beak-like portion 48 of the sealing zone 46 makes it possible to minimize a stripping force required in opening the cover sheet 14, thus allowing the user to begin to strip off the cover sheet 14 to open the cavity 24 with a relatively small stripping force. Accordingly, a reaction in the container body 12 against the stripping-off of the cover sheet 14 is minimized, thus preventing that a relatively large amount of preserving solution 18 is spilled from the opening 32 of the cavity 24, thereby assuring an excellent removal of the contact lens 16 from the container body 12 in a further effective manner.

Still further, the cover sheet 14 can be sealed to the container body 12 by effecting the heat sealing at the projection 44 formed on the container body 12, in the present embodiment, the sealing zone 46 can be desirably formed with high preciseness and stability, assuring an improved production efficiency and an improved fluid-tight sealing in an effective manner.

There will be next described some blister packages constructed according to other preferred embodiments of the present invention, by way of example. In the following description, the same reference numerals as used in the first embodiment will be used in the following embodiments to identify the corresponding components, and redundant description of these components will not be provided.

Figure 5:
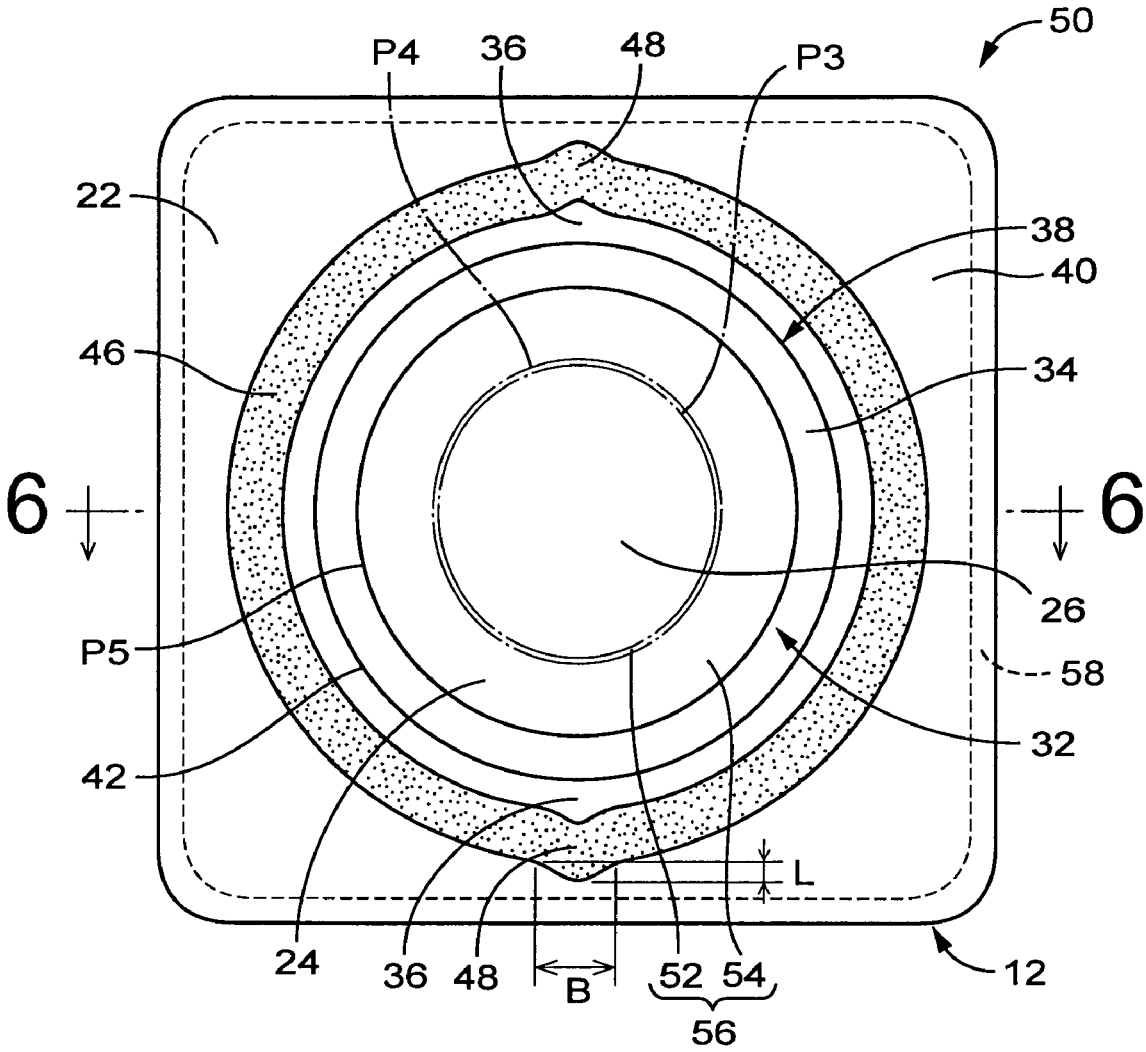
FIG. 5 is a top plane view of a blister package according to a second embodiment of the invention, where a cover sheet of the blister package is not secured.
Figure 6:
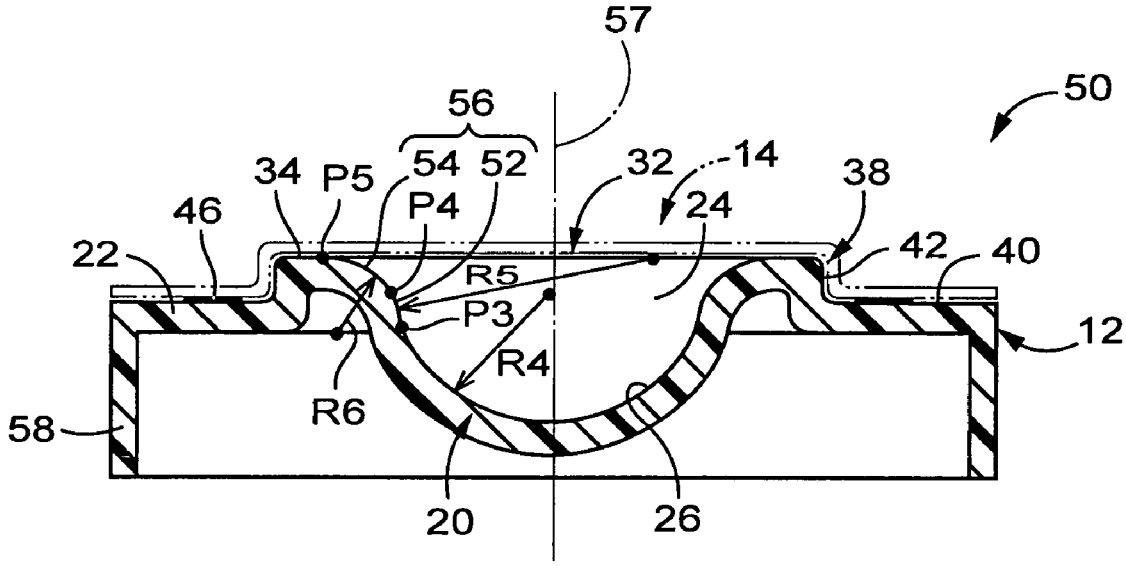
FIG. 6 is a cross sectional view taken along line 6-6 of FIG. 5.

Referring next to FIGS. 5-6, a blister package 50 is shown as a second embodiment of the ophthalmic lens storage container the present invention. The blister package 50 is different from the blister package 10 of the first embodiment as to (i) the shape of the guide surface, and (ii) the shape of the open-end peripheral portion in the opening 32 of the cavity 24.

In the blister package 50 of the present embodiment, the cavity 24 has a concave surface 52 in an open-end side portion located near the opening 32. The concave surface 52 has a radius of curvature R5 that is made larger than a radius of curvature R4 of the bottom surface 26. Namely, the concave surface 52 has an inwardly curve shape in cross section, which curve extends slightly radially outwardly in the second direction along which the cavity 24 is open. This concave surface 52 and the bottom surface 26 join together smoothly along knots P3 lying on tangents common to these surfaces 52, 26. Also, the cavity 24 has a chamfered surface 54 provided in the open-end peripheral portion of the cavity 24 which might provide an edge. The chamfered surface 54 has an outwardly curved shape in cross section, thereby removing the possible edge on the open-end peripheral portion of the cavity 24. Specifically, the chamfered surface 54 has a parabolic shape in cross section whose radius of curvature R6 gradually increases toward the outer peripheral portion of the opening 32. The inner peripheral portion of the chamfered surface 54, where the radius of curvature is made smaller, is connected to the outer peripheral portion of the guide surface 52 along knots P4 lying on tangents common to curves of these surfaces 54, 52, while the outer peripheral portion of the chamfered surface 54, where the radius of curvature is made larger, is connected to the plane surface 34 along knots P5 lying on lines tangent to the curve of the chamfered surface 54 and lying on the plane surface 34. Namely, in the present embodiment, the guide surface 56 includes two segments, i.e., the concave surface 52 and the chamfered surface 54, which have different radius of curvatures. It is noted that the chamfered surface 54 serves as the segment of the guide surface 30, as well as the open-end peripheral portion of the cavity 24 extending circumferentially with the outwardly curved shape in cross section to be convex in the second direction along with the cavity 24 is open.

The cavity 24, the guide surface 56 consisting of the concave surface 52 and the chamfered surface 54, the plane surface 34 and the shoulder surface 42 are all shaped as a solid of revolution about a center axis 57 of the cavity, whose cross sectional shape is made constant over the entire circumference about the center axis. The flange 22, which is contiguous to the shoulder surface 42, has a generally square shape in a plane view. For the purpose of reinforcement, the flange 22 includes a peripheral upright wall 58 integrally formed at the peripheral portion of the flange 22 so as to extend downwardly, and circumferentially over the entire periphery of the flange 22. The protruding end of the peripheral upright wall 58 is located downward of the bottom of the lens storage portion 20 in the vertical direction, so that the peripheral upright wall 58 functions as a support member. The sealing zone 46 formed on the flange 22 has a generally annular shape as seen in FIG. 5, and is located radially outward of the shoulder surface 42 so as to surround the shoulder surface 42 over the entire circumference while having a generally constant width. Like the first embodiment, the sealing zone 46 may be formed when the cover sheet 14 is heat sealed to the flange 22, where the cover sheet 14 is superposed on the projection 44 integrally formed on the flange 22, and then the surface of the cover sheet 14 is heat pressed onto the flange 22, whereby the cover sheet 14 is fusion-welded to the projection 44.

The sealing zone 46 includes a pair of beak-like portions 48, 48 formed on the respective circumferential portions diametrically opposed to each other. Each of the beak-like portions 48, 48 is arranged to have the length L in the protruding direction is made smaller than the length L in the beak-like portion 48 in the first embodiment, and the ratio B/L of the width dimension B of the beak-like portion at the base to the length L from the base to the tip of the beak-liked portion is arranged to be substantially equal to 5 ($B/L \approx 5$).

In the present embodiment, the shape and size of the open-end peripheral portion of the cavity 24 that includes the guide surface 56 and the plane surface 34 are not particularly limited, but may be suitably determined taking into account of the material, shape and size of the contact lens 16 and efficiency in using and manufacturing the blister package. Some specific examples of the open-end peripheral portion of the cavity 24 will be described in detail in conjunction with FIGS. 7-12. It should be appreciated that the invention is by no means limited to the details of the following examples.

Figure 7:
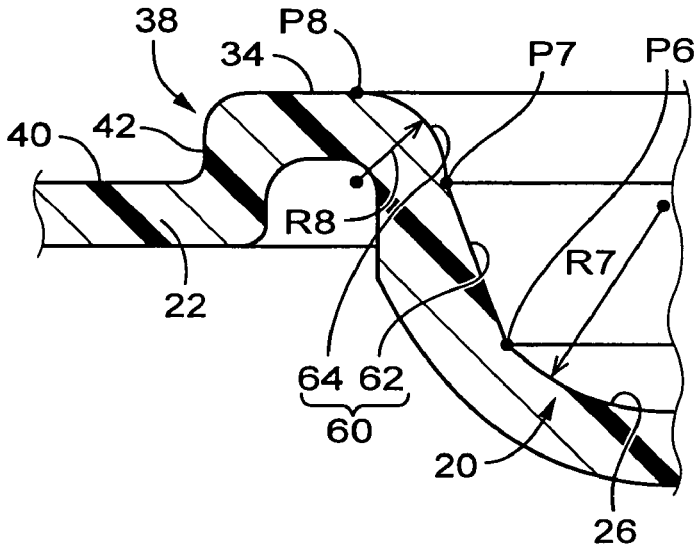
FIG. 7 is a fragmentally enlarged cross sectional view for showing one example of a guide surface adoptable in a blister package of the invention.

FIG. 7 shows a guide surface 60 partially defining the open-end peripheral portion of the cavity 24. The guide surface 60 is shaped as a solid of revolution about a center axis of the cavity 24, and consists of two parts, namely a sloped surface 62 as a first segment and a chamfered surface 64 as a second segment. The sloped surface 62 is discontinuously connected to the bottom surface 26 having a radius of curvature R7 along knots P6 with a peak or a junction. As seen in the cross section of FIG. 7, the sloped surface 62 extends straightly from the knots P6 with a generally constant slope in the second direction, i.e., in the vertically upward direction as seen in FIG. 7, and the chamfered surface 64 has an outwardly curved shape in cross section, protruding outward in the second direction and having a relatively small radius of curvature R8. The chamfered surface 64 is discontinuously connected to the sloped surface 62 along knots P7 with a peak created, while being smoothly connected to the plane surface 34 along knots P8 without creating any peak or junction.

Figure 8:
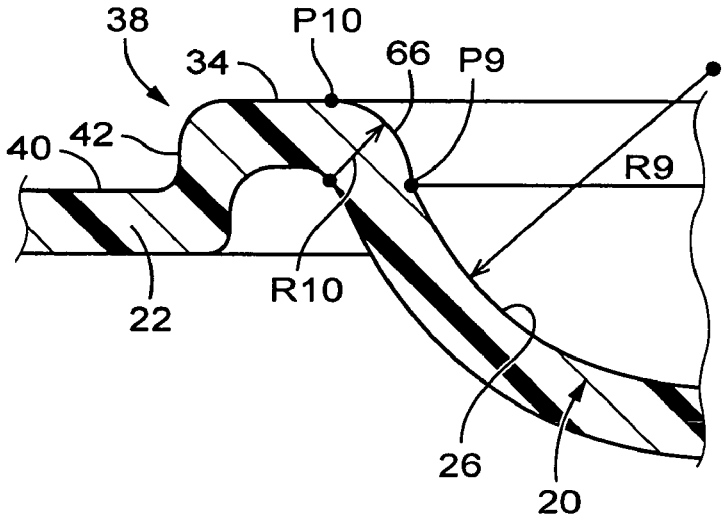
FIG. 8 is a fragmentally enlarged cross sectional view for showing another example of a guide surface adoptable in a blister package of the invention.

FIG. 8 shows a guide surface 66 partially defining the open-end peripheral portion of the cavity 24. The guide surface 66 is shaped as a solid of revolution about a center axis of the cavity 24, and has an outwardly curved or convex shape in cross section that protrudes outwardly in the second direction and has a radius of curvature R10 that is made smaller than a radius of curvature R9 of the bottom surface 26 of the cavity 24. The guide surface 66 is discontinuously connected to the bottom surface 26 along knots P9 with a peak created, while being smoothly connected to the plane surface 34 along knots P10 without creating any peak. As is understood from the foregoing description, the guide surface 66 serves as a chamfered surface provided to eliminate possible edge of the open-end peripheral portion of the cavity 24.

Figure 9:
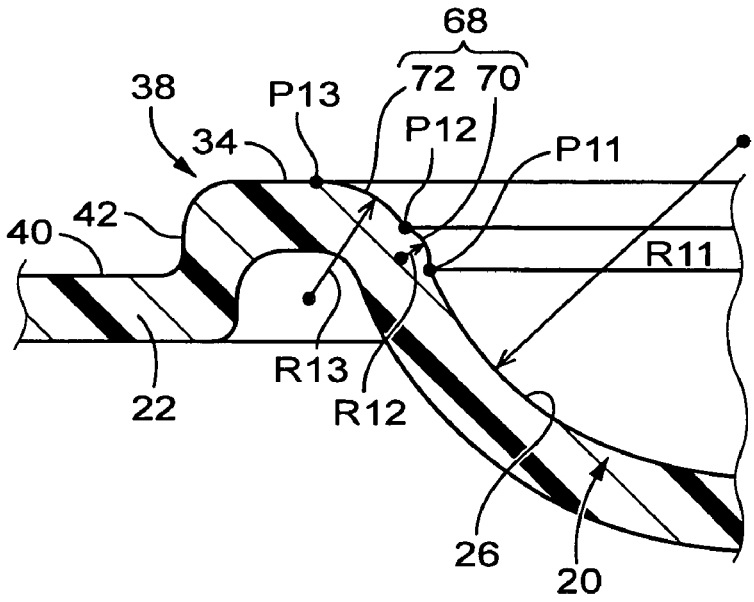
FIG. 9 is a fragmentally enlarged cross sectional view for showing yet another example of guide surface adoptable in a blister package of the invention.

FIG. 9 shows a guide surface 68 partially defining the open-end peripheral portion of the cavity 24. The guide surface 68 consists of two parts, namely an outwardly curved surface 70 as the first segment and a chamfered surface 72 as the second segment. The outwardly curved surface 70 has a convex shape in cross section to protrude outwardly in the second direction, and has a radius of curvature R12 that is made sufficiently smaller than a radius of curvature R11 of the bottom surface 26 of the cavity 24. The outwardly curved surface 70 is discontinuously connected to the bottom surface 26 along knots P11 with a peak created. The chamfered surface 72 has an outwardly curved or convex shape in cross section to protrude outwardly in the second direction, and has a radius of curvature R13 that is made larger than the radius of curvature R12 of the outwardly curved surface 70 and smaller than the radius of curvature R11 of the bottom surface 26. The chamfered surface 72 is discontinuously connected to the outwardly curved surface 70 along knots P12 with a peak created, while being smoothly or continuously connected to the plane surface 34 along knots P13 without creating any peak.

Figure 10:
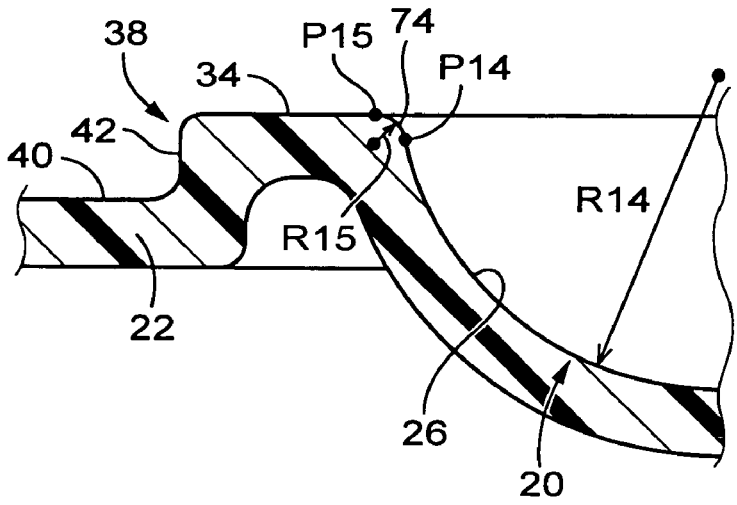
FIG. 10 is a fragmentally enlarged cross sectional view for showing still another example of guide surface adoptable in a blister package of the invention.

FIG. 10 shows the open-end peripheral portion of the cavity 24 where a chamfered surface 74 is provided. The chamfered surface 74 has an outwardly curved or convex shape in cross section to protrude outwardly in the second direction, and has a radius of curvature R15 that is made sufficiently smaller than a radius of curvature R14 of the bottom surface 26. The chamfered surface 74 continuously extends in the circumferential direction over the entire circumference of the cavity 24. The chambered surface 74 is smoothly and continuously connected at its inner periphery to the bottom surface 26 along knots P14 lying on tangents common to surfaces 74, 26, and at its outer periphery to the plan surface 34 along knots P15 lying on lines tangent to the chamfered surface 74 and lying on the plane surface 34. The radius of curvature R15 of the chamfered surface 74 may be suitably adjusted to be served as a guide surface that defines the open-end side portion of the cavity 24.

Figure 11:
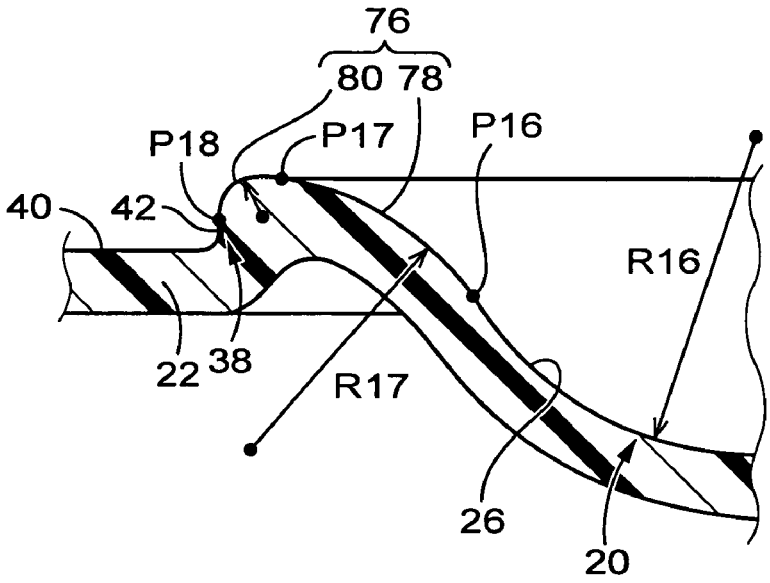
FIG. 11 is a fragmentally enlarged cross sectional view for showing a further example of guide surface adoptable in a blister package of the invention.

FIG. 11 shows a guide surface 76 partially defining the open-end peripheral portion of the cavity 24. The guide surface 76 consists of two parts, namely a first chamfered surface 78 as the first segment and a second chamfered surface 80 as the second segment. The first chamfered surface 78 has an outwardly curved or convex shape in cross section to protrude outwardly in the second direction, and has a radius of curvature R17 that is made smaller than a radius of curvature R16 of the bottom surface 26. The first chamfered surface 78 is continuously connected to the bottom surface 26 along knots P16 without creating any peak or junction. The second chamfered surface 80 has an outwardly curved or convex shape in cross section to protrude outwardly in the second direction, and has a radius of curvature R18 that is made smaller than the radius of curvature R17 of the first chamfered surface 78. The second chamfered surface 80 is smoothly connected at both sides thereof to the first chamfered surface 78 and the shoulder surface 42 of the shoulder portion 38 along knots P17, P18 with no peak created, respectively. That is, in this specific example, the guide surface 78 and the shoulder surface 42 of the shoulder portion 38 directly smoothly join together, without disposing the plane surface 34 in between.

Figure 12:
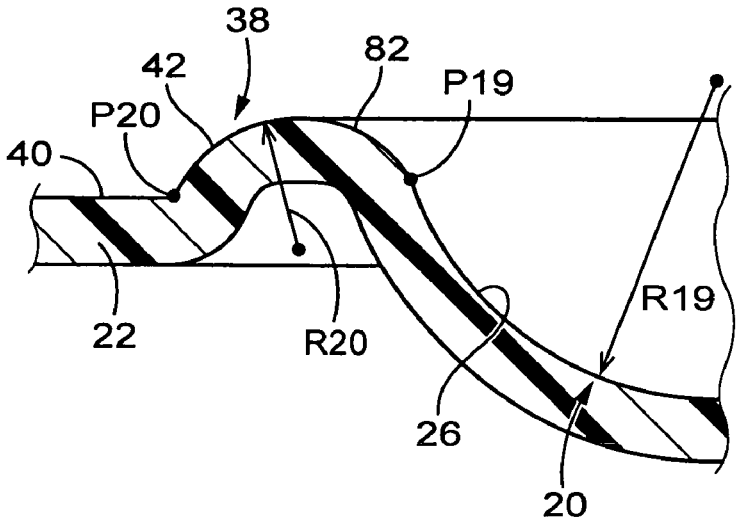
FIG. 12 is a fragmentally enlarged cross sectional view for showing a still further example of guide surface adoptable in a blister package of the invention.

FIG. 12 shows the open-end peripheral portion of the cavity 24 where a chamfered surface 82 is provided. The chamfered surface 82 has an outwardly curved or convex shape in cross section to protrude outwardly in the second direction, and has a radius of curvature R20 that is made smaller than a radius of curvature R19 of the bottom surface 26. The chamfered surface 82 is continuously or smoothly connected to the bottom surface 26 along knots P19 with no peak created, while being discontinuously connected to the lower surface 40 of the flange 22 along knots P20 with a peak created. That is, in this specific example, the chamfered surface 82 serves as a guide surface at its inner circumferential portion, while functioning at its outer peripheral portion to form the shoulder surface 42 of the shoulder portion 38.

In the illustrated second embodiment, the shape and sizes of the beak-like portion 48 of the sealing zone 46 is not particularly limited, but may be preferably determined or adjusted with materials, shapes, and sizes or other suitable parameters of the container body 12 and the cover sheet 14 taken into consideration. Some examples of the beak-like portions adoptable in the present invention will be described in conjunction with FIGS. 13-15.

Figure 13:
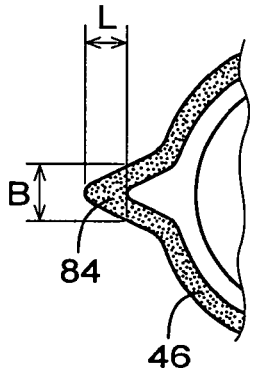
FIG. 13 is a fragmentally enlarged cross sectional view for showing one example of a beak-like portion adoptable in a blister package of the invention.
Figure 14:
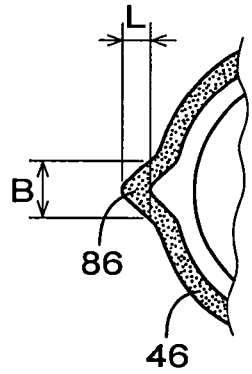
FIG. 14 is a fragmentally enlarged cross sectional view for showing another example of a beak-like portion adoptable in a blister package of the invention.
Figure 15:
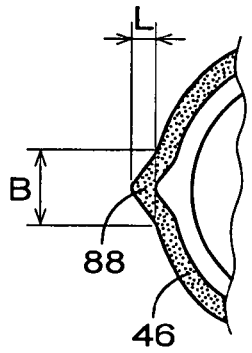
FIG. 15 is a fragmentally enlarged cross sectional view for showing yet another example of a beak-like portion adoptable in a blister package of the invention.

FIG. 13 shows a beak-like portion 84 formed in one circumferential portion of the sealing zone 46 designated as an intended stripping start point, where the ratio B/L is determined to satisfy the following inequality, $1<B/L<2$. FIG. 14 shows a beak-like portion 86 formed in one circumferential portion of the sealing zone 46 designated as an intended stripping start point, where the ratio B/L is determined to satisfy the following inequality, $2<B/L<3$. FIG. 15 shows a beak-like portion 88 formed in one circumferential portion of the sealing zone 46 designated as an intended stripping start point, where the ratio B/L is determined to satisfy the following inequality, $3<B/L<4$.

In the blister package 50 constructed according to the second embodiment as described above, the sealing zone 46 at which the cover sheet 14 is stripably sealed to the container body 12, is located axially or vertically downward of the plane surface 34 by the shoulder portion 38 interposed therebetween in the vertical direction as seen in FIG. 6, like the blister package 10 of the first embodiment. Therefore, the blister package 50 can enjoy the same advantages of the present invention, which are described above with respect to the blister package 10, and is capable of preventing the contact lens being damaged when being removed from the container body 12.

According to the second embodiment of the invention, the suitable one of the illustrated examples of the guide surface as shown in FIGS. 7-12 can be adopted, thereby facilitating or actively inducing removal of the contact lens by sliding the contact lens over the bottom surface 26 and the guide surface in this order.

Further, the sealing zone 46 includes the pair of beak-like portions 48, 48 opposed to each other in one diametric direction. In this arrangement, the blister package 50 can be opened from any side of the pair of beak-like portions 48, 48, and unsealed one of the pair of the beak-like portions 48, 48 can serve as a seal-retaining portion, resulting in improved efficiency in using and manufacturing the blister package 50.

Figure 16:
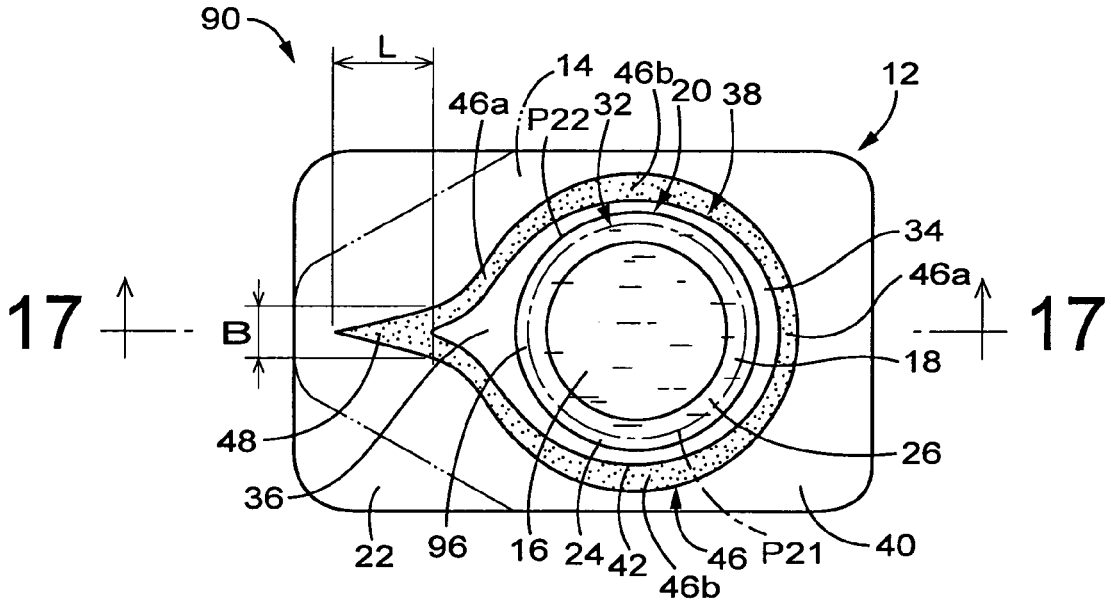
FIG. 16 is a top plane view of a blister package according to a third embodiment of the invention, where a cover sheet of the blister package is not secured.
Figure 17:
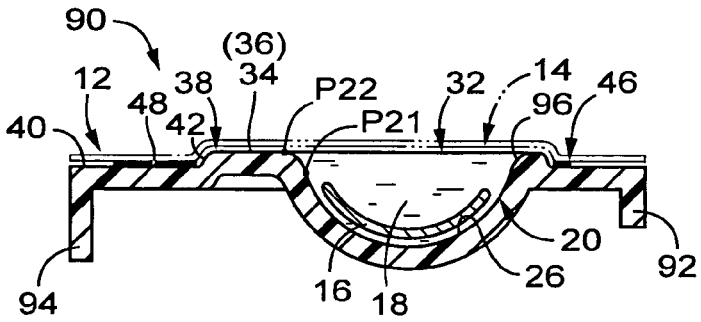
FIG. 17 is a cross sectional view taken along line 17-17 of FIG. 16.

Referring next to FIGS. 16 and 17, a blister package 90 is shown as a third embodiment of the ophthalmic lens storage container of the present invention. The blister package 90 is different from the blister packages 10, 50 according to the first and second embodiments in terms of the width dimension, the shape and the like of the sealing zone 46.

In the blister package 90 constructed according to the present embodiment, the lens storage portion 20 has a generally semi-spherical shell shape in its entirety, and a generally semi-spherical cavity 24 is formed within the storage portion 20. The flange 22 has a generally rectangular conFIGuration in a plane view shown in FIG. 16, and an upright rib 92 for reinforcing the container body 12 and a grip member 94 for helping a stripping operation are integrally formed at opposite sides of a peripheral portion of the flange 22 so as to extend in the vertically downward direction as seen in FIG. 17.

A guide surface 96 is provided in the open-end peripheral portion of the cavity 24 so as to continuously extend circumferentially over the entire circumference of the cavity with a substantially constant outwardly curved or convex shape in cross section that protrudes outward in the second direction with a generally constant radius of curvature that is smaller than that of the bottom surface 26 of the cavity 24. The guide surface 96 is smoothly connected to the bottom surface 26 along knots P21 lying on tangents common to these surfaces 26, 96, while being smoothly connected to the plane surface 34 along knots P22 lying on lines tangent to the guide surface 96 and lying on the plane surface 34. The opening 32 of the cavity 24 has a generally circular shape. As is understood from the afore the description, the guide surface 96 may be formed as a chamfered surface to eliminate an edge in the open-end peripheral portion of the cavity 24.

While the plane surface 34 is connected to the guide surface 96 at its inner circumferential surface over the entire circumference, the width dimension of the plane surface 34 varies in the circumferential direction so that the outer peripheral portion of the plane surface 34 surrounds the opening 32 of the cavity 24 with a generally ellipsoidal shape. One of two circumferential portions opposed to each other in a major axial direction of the plan surface 34, extends outwardly to form the acute projection 36.

Further, the outer periphery of the sealing zone 46 formed on the lower surface 40 is shaped in a generally circular shape, although the inner periphery of the sealing zone 46 is made ellipsoidal. As a result, the width dimension of the sealing zone 46 varies in the circumferential direction. Namely, a width dimension as measured in circumferential positions 46*a*, 46*a* opposed in a major axial direction of the sealing zone 46 is made smaller than a width dimension as measured in circumferential positions 46*b*, 46*b* opposed in a minor axial direction of the sealing zone 46. In the present embodiment, the major axial direction conforms to a direction along which the cover sheet 14 is intended to be stripped off, and the circumferential portions 46*b*, 46*b* opposed to the minor axial direction perpendicular to the major axial direction have the maximized width dimension.

The blister package 90 constructed according to the present embodiment is characterized in that the width dimension of the sealing zone 46 is desirably changed in the circumferential direction, making it possible to adjust a stripping force required in opening the cover sheet 14. For instance, it is also possible to even the stripping force for opening the cover sheet 14 over the entire circumference.

Figure 18:
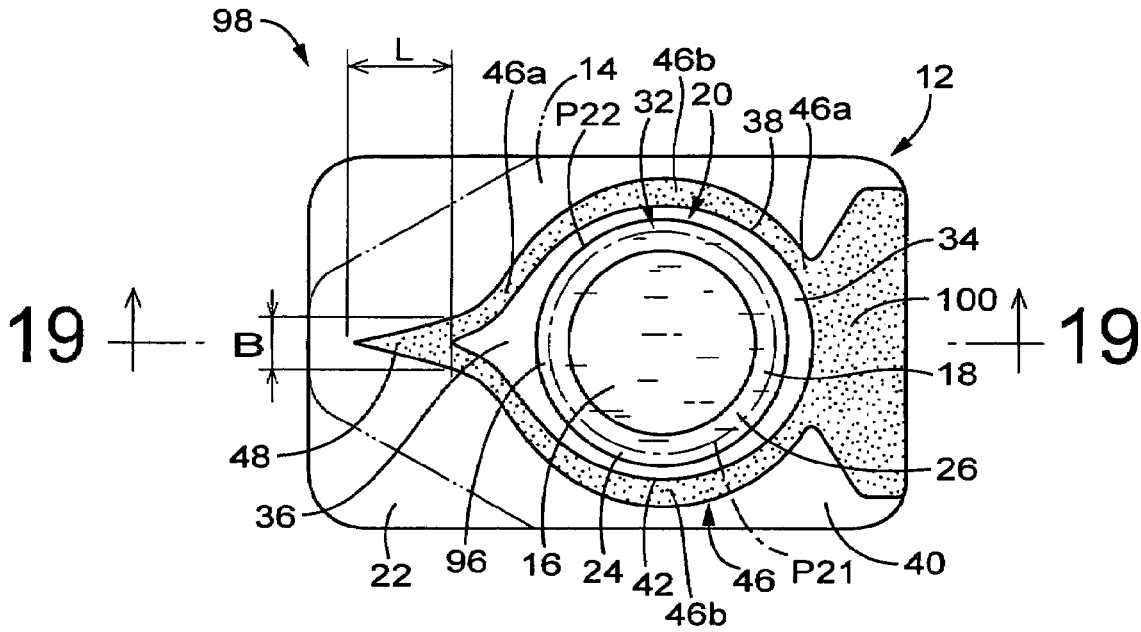
FIG. 18 is a top plane view of a blister package according to a fourth embodiment of the invention, where a cover sheet of the blister package is not secured.
Figure 19:
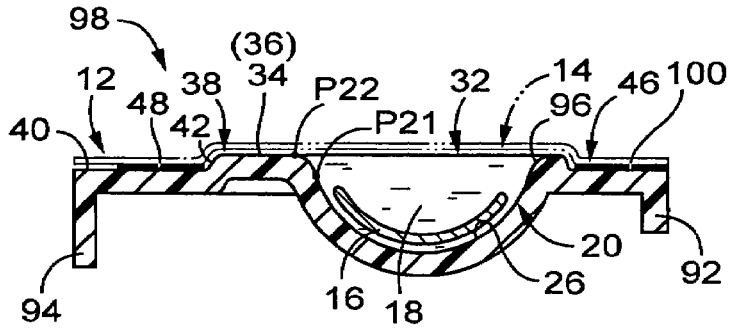
FIG. 19 is a cross sectional view taken along line 19-19 of FIG. 18.

Referring next to FIGS. 18 and 19, a blister package 98 is shown as a fourth embodiment of the ophthalmic lens storage container of the present invention. This blister package 98 is different from the blister package 90 according to the illustrated third embodiment of the invention in that a seal-retaining portion 100 is additionally formed.

The seal-retaining portion 100 is formed in a circumferential portion of the sealing zone 46, which portion is opposed to the beak-like portion 48 with the opening 32 of the cavity 24 interposed therebetween, so as to extend radially outwardly with a given width dimension. The seal-retaining portion 100 has a generally rectangular shape in a plane view shown in FIG. 18, and extends to the outer peripheral portion of the flange 22. The width dimension of the seal-retaining portion 100 is made substantially equal to or larger than the dimension of the opening 32 of the cavity 24.

In the blister package 98 constructed according to the present embodiment, since the seal-retaining portion 100 is formed on the opposite side of the beak-like portion 48, the sealing portion 100 can prevent or restrict the cover sheet 14 being stripped off from the container body 12 in an accelerative manner at the opposite side of the beak-like portion 48, making it possible to expose the opening 32 of the cavity 24 in a stable manner. Also, the seal-retaining portion 100 permits the partially stripped cover sheet 14 for opening the cavity 24 to be still sealed to the container body 12, making it easy to handle the container body 12 and the cover sheet 14 after the blister package 98 is opened.

Figure 20:
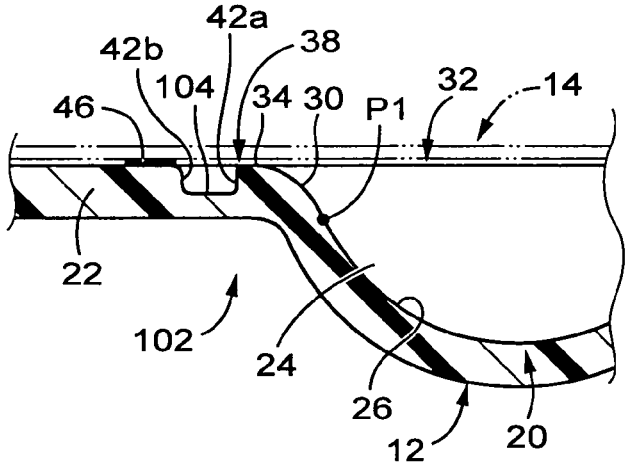
FIG. 20 is a fragmentally enlarged view in cross section of a blister package according to a fifth embodiment of the invention.

Referring next to FIG. 20, there is shown a principle part of a blister package 102 constructed according to a fifth embodiment of the ophthalmic lens storage container of the present invention in an enlarged manner. The blister package 102 is different from the first embodiment, as to the structure of the insulating portion having a shoulder surface extending in the first direction opposite to the second direction along which the cavity 24 is open.

Described in detail, the blister package 102 according to the present invention does not have the lower surface 40, and the flange 22 and the plane surface 34 are generally made flush with each other.

In the present embodiment, a groove 104 functioning as an insulating portion is formed in a portion of the flange 22 adjacent to the plane surface 34. The groove 104 is open in the upper surface of the flange 22 and extends circumferentially so as to surround the opening 32 of the cavity 24 continuously. That is, the groove 104 is partially defined by an inner circumferential wall 42*a* and an outer circumferential wall 42*b*, and the inner circumferential wall 42*a* functions as the shoulder surface 42.

The sealing zone 46 is formed in a portion of the flange 22, which is located radially outward of the groove 104. That is, the sealing zone 46 is separated from the guide surface 30 and the plane surface 34 by means of the groove 104 interposed therebetween, thereby being substantially insulated from the guide surface 30 and the plane surface 34.

Figure 21:
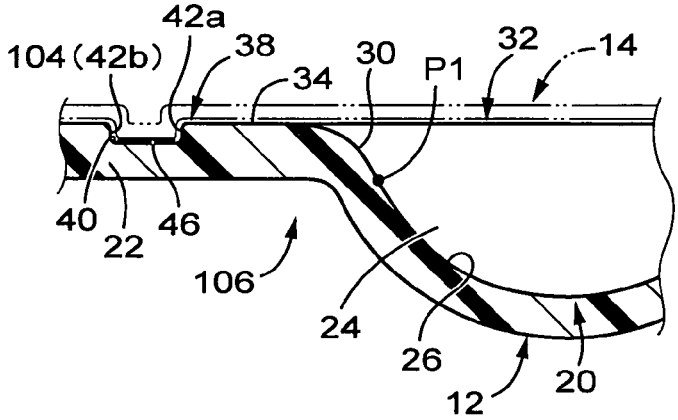
FIG. 21 is a fragmentally enlarged view in cross section of a blister package according to a sixth embodiment of the invention.

Referring next to FIG. 21, there is shown a principle part of a blister package 106 constructed according to a sixth embodiment of the ophthalmic lens storage container of the present invention in an enlarged manner. The blister package 106 is different from the fifth embodiment, as to the position of the sealing zone 46.

In the blister package 106 of the present embodiment, the sealing zone 46 is formed on the bottom surface of the groove 104, and the inner circumferential wall 42*a* separates the sealing zone 46 and the plane surface 34 in the height or vertical direction as seen in FIG. 21, whereby the sealing zone 46 is substantially insulated from the guide surface 30 and the plane surface 34. In the present embodiment, the bottom surface of the groove 104 provides a lower surface.

The blister package 106 constructed as described above can enjoy the same advantages of the present invention explained above with respect to the illustrated embodiments. In addition, the groove 104 completely houses the sealing zone 46 and prevents protrusion of the sealing zone 46 from the flange 22. This arrangement, for example, permits the cover sheet 14 to be readily printed, in a later step.

Figure 22:
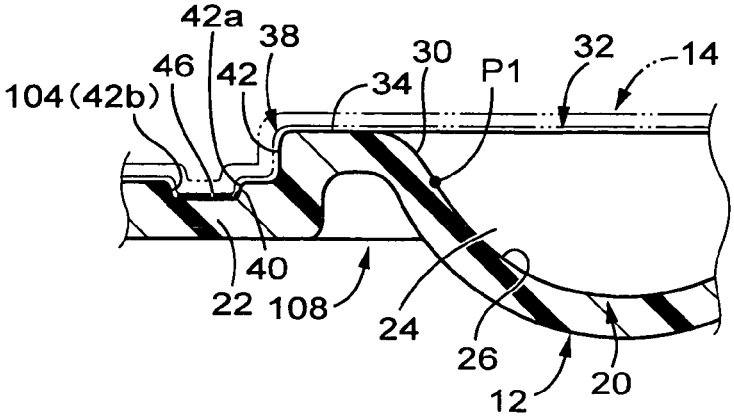
FIG. 22 is a fragmentally enlarged view in cross section of a blister package according to a seventh embodiment of the invention.

Referring next to FIG. 22, there is shown a principle part of a blister package 108 constructed according to a seventh embodiment of the ophthalmic lens storage container of the present invention in an enlarged manner. The blister package 108 is different from the blister package 10 of the first embodiment in that the sealing zone 46 at which the cover sheet 14 is sealed to the container body 12, is formed on the bottom surface of the groove 104 that is formed in the flange 22 and located radially outward of the shoulder portion 38. In the present embodiment, the bottom surface of the groove 104 provides a lower surface. In this arrangement, the sealing zone 46 is spaced away from the plane surface 34 by means of the shoulder surface 42 of the shoulder portion 38 and the inner circumferential wall 42*a* of the groove 104 functioning as the shoulder surface 42, in the height or vertical direction as seen in FIG. 22, thereby being substantially insulated from the guide surface 30 and the plane surface 34.

Figure 23:
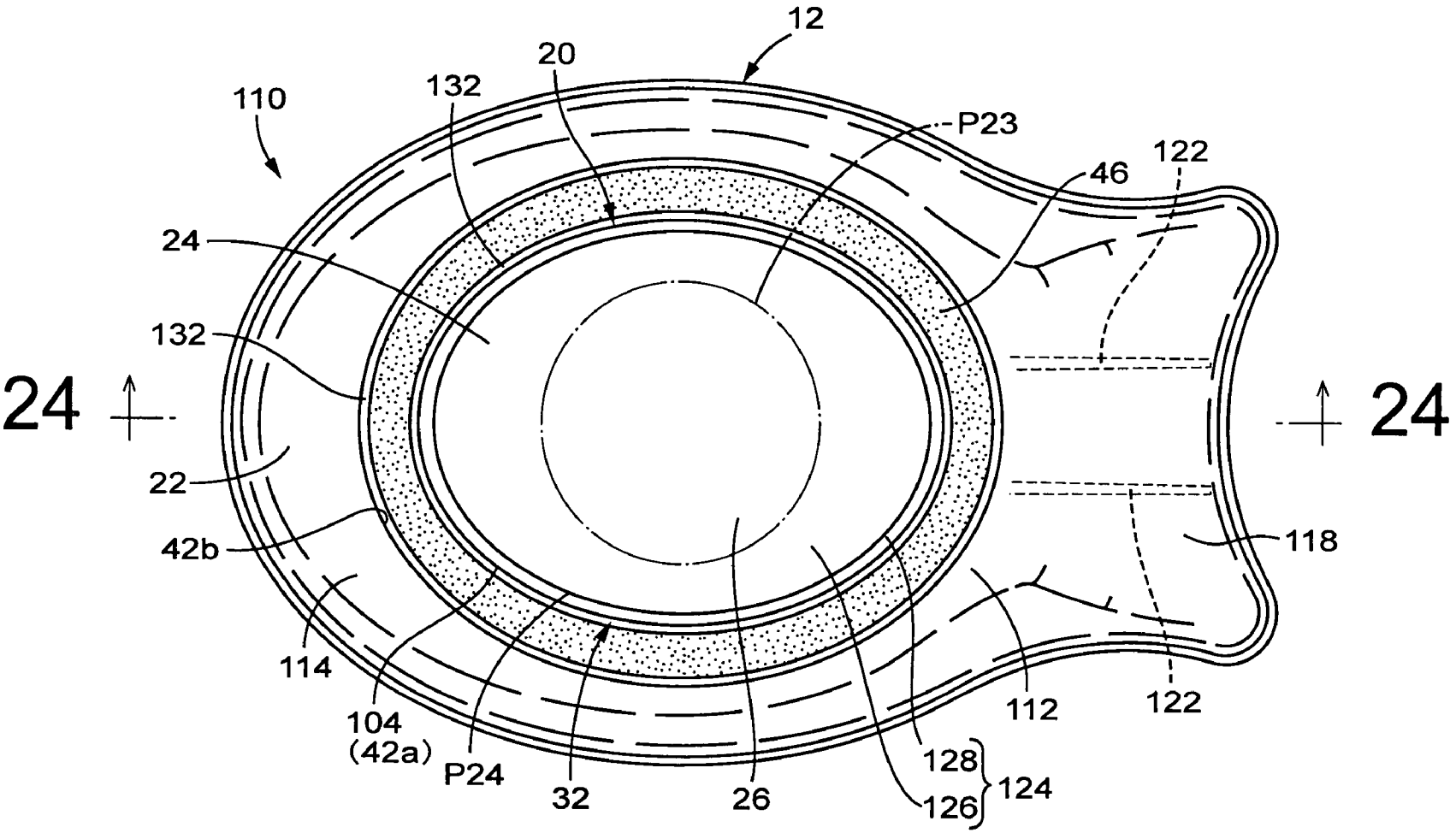
FIG. 23 is a fragmentally enlarged view in cross section of a blister package according to an eighth embodiment of the invention.
Figure 24:
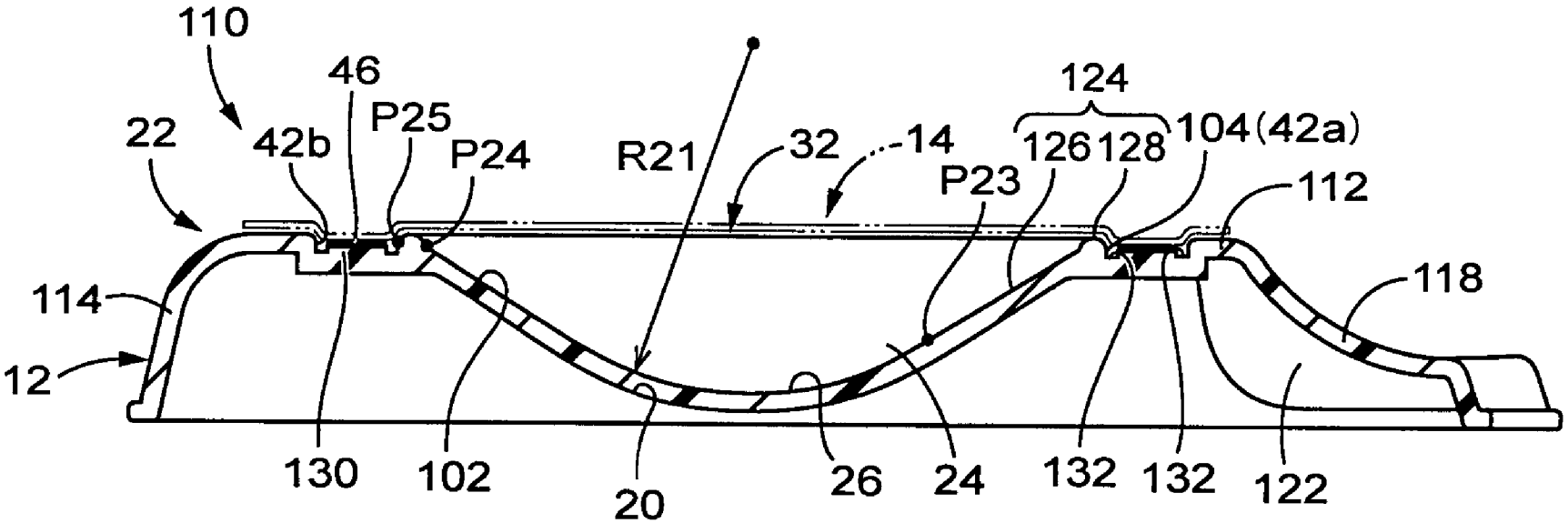
FIG. 24 is a cross sectional view taken along line 24-24 of FIG. 23.

Referring next to FIGS. 23 and 24, a blister package 110 is shown as an eighth embodiment of the ophthalmic lens storage container of the present invention. The blister package 110 is substantially different from the blister package 10 of the first embodiment, as to (i) the shape of the guide surface and (ii) the shape of the open-end peripheral portion in the opening 32 of the cavity 24.

In the blister package 110 of the present embodiment, the lens storage portion 20 has a generally semi-spherical shell shape that is made somewhat flat in a thickness direction, and the cavity 24 formed within the lens storage portion 20 has the bottom surface 26 whose inwardly curved or convex surface has a generally constant radius of curvature R21. The flange 22 comprises a plane surface 112 that surrounds the open-end peripheral portion of the cavity 24 and extends outwardly from the open-end peripheral portion of the cavity 24 in a direction perpendicular to the second direction along which the cavity 24 is open. The blister package 110 has a generally ellipsoidal shape in its entirety as seen in a plane view shown in FIG. 23. Further, a peripheral cylindrical wall 114 is integrally formed at the peripheral portion of the flange 22 so as to extend in the first direction that is opposed to the second direction along which cavity 24 is open.

A caudal-fin shaped portion 118 is integrally formed in one of opposite ends of the flange 22 in the main axis direction. The caudal-fin shaped portion 118 has an inwardly curved or concave shape in cross section as shown in FIG. 24, and is reinforced by rib 122, 122 integrally formed on its lower surface, and has a generally swallowtail shape in a plane view shown in FIG. 23, whereby the flange 22 has a fish-like shape in its entirety as seen in the plane view. The peripheral cylindrical wall 114 protrudes outward from the bottom of the lens storage portion 20 in the first direction. The protruding end of the cylindrical wall 114 is bent radially outward, to thereby provide an annular support surface.

In the present embodiment, a guide surface 124 consists of two parts, namely a sloped surface 126 as the first segment and an outwardly curved surface 128 as the second segment. The sloped surface 126 is continuously connected to the bottom surface 26 at knots P23 with no peak. As seen in the cross section of FIG. 24, the sloped surface 126 extends straightly from the knots P23 with a generally constant slope in the second direction, i.e., in the vertically upward direction. The outwardly curved surface 104 is formed in the open-end peripheral portion of the cavity 24, and has a generally semi circular shape in cross section so as to protrude outward in the second direction along which the cavity 24 is open. The outwardly curved portion 104 has a radius of curvature R22 (not shown) that is made sufficiently smaller than that of the bottom surface 26, and is connected at an inner peripheral portion to the sloped surface 126 along knots P24, and at an outer peripheral portion to the plane surface 112 along knots P25. The outwardly curved surface 128 is dimensioned so that the protruding end face is substantially flush with the plane surface 112. As is understood from the afore the description, the outwardly curved surface 128 serves as one of the segment of the guide surface, and functions to remove possible edges on the open-end peripheral portion of the cavity 24.

The flange 22 is further provided with the groove 104 disposed in the radially outward of the guide surface 124 and extending continuously in the circumferential direction over the entire circumference thereof. The groove 104 functioning as an insulating portion is open in the upper surface of the flange 22, and the inner circumferential wall 42*a* and outer circumferential wall 42*b* of the groove 104 function as the shoulder surface. The bottom surface of the groove 104 is provided with the base portion 130 protruding in the second direction formed in a central portion in the width direction and extending continuously in the circumferential direction over the entire circumference of the groove 104. Thus, the base portion 130 cooperates with the inner and outer circumferential walls 42*a*, 42*b* to form therebetween a pair of small grooves 132, 132 extending continuously over the circumference of the groove 104. The base portion 130 is dimensioned to have a height that is made smaller than the depth dimension of the groove 104.

The cover sheet 14 is superposed on and sealed to the base portion 130 by welding or the like. That is, the sealing zone 46 formed by the base portion 130 welded is substantially insulated from the guide surface 124 by the shoulder surface 42*a* of the groove 104.

In particular, the fish-like shaped container body 12 can give a taste of design to the blister package 110.

Figure 25:
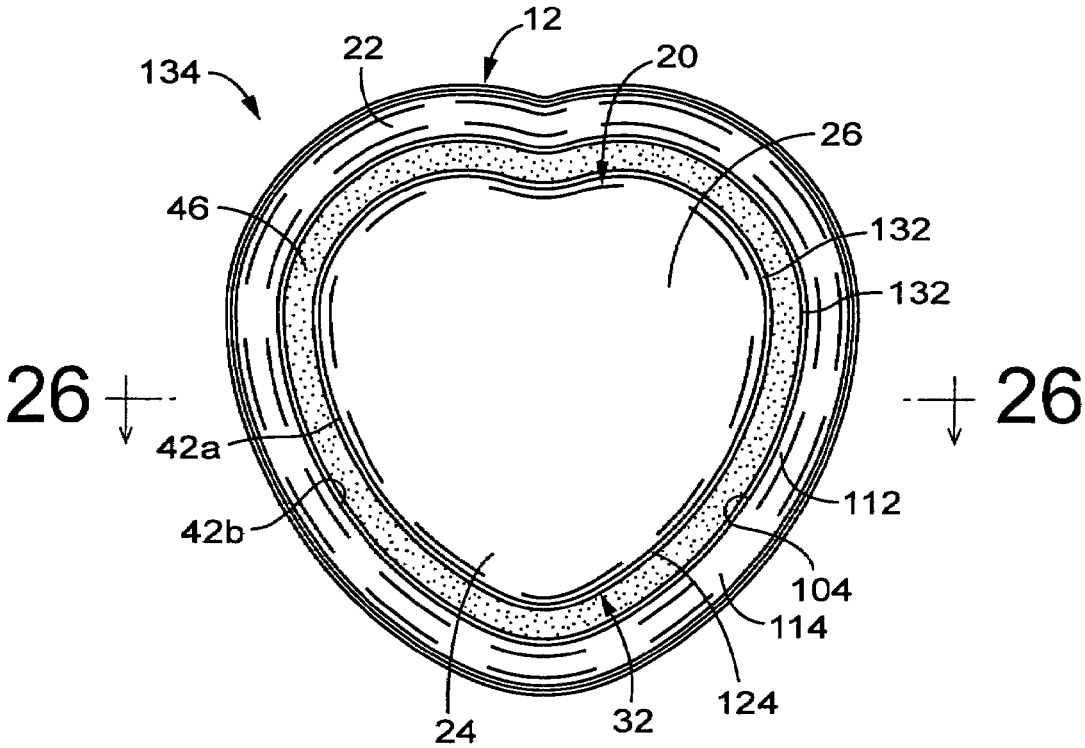
FIG. 25 is a top plane view of a blister package according to a ninth embodiment of the invention, where a cover sheet of the blister package is not secured.
Figure 26:
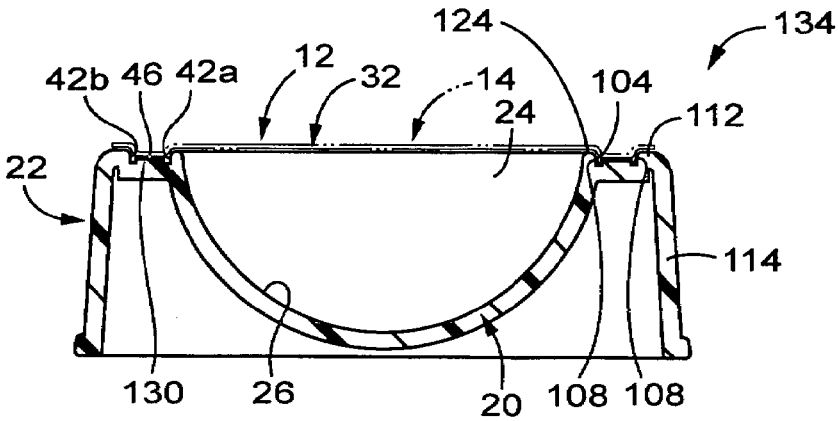
FIG. 26 is a cross sectional view taken along line 26-26 of FIG. 25.
Figure 27:
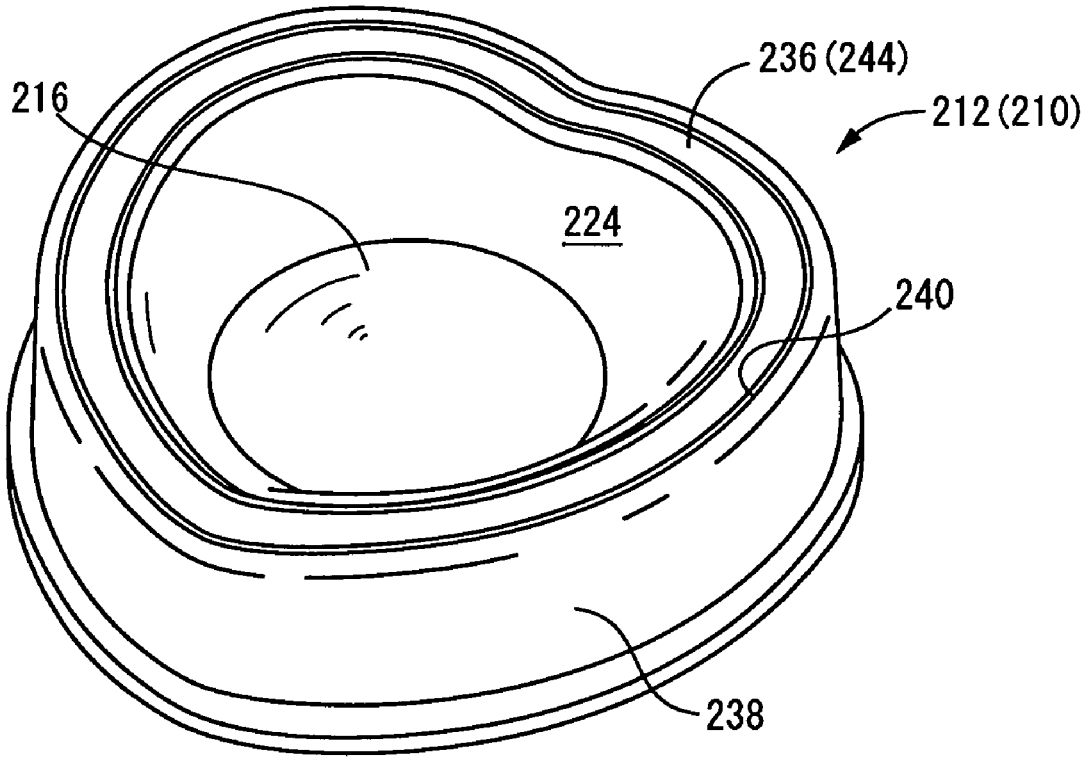
FIG. 27 is a perspective view of a container body of a blister package according to a tenth embodiment of the present invention, where a contact lens is stored.

Referring next to FIGS. 25 and 26, a blister package 134 is shown as a ninth embodiment of the ophthalmic lens storage container of the present invention. The blister package 134 is different from the blister package 110 of the eighth embodiment in the shape of the container body 12.

In the blister package 134, the bottom surface 26 has an inwardly curved or concave surface whose radius of curvature varies in the circumferential direction to have a generally heart shape in a plane view shown in FIG. 25. The flange 22 comprises a plane surface 112 that surrounds the open-end peripheral portion of the cavity 24 and extends outwardly from the open-end peripheral portion of the cavity 24 in a direction perpendicular to the second direction along which the cavity 24 is open (upward direction as seen in FIG. 26). The plane surface 112 also has a generally heart shape corresponding to and slightly larger than the cavity 24. The open-end peripheral portion of the cavity 24 is provided with a suitable radius to be chamfered. The cavity 24 has no apparent guide surface in the present embodiment, and the bottom surface 26 extends to the open-end peripheral portion of the cavity 24 with a generally constant radius of curvature, and is directly connected to the flange 22 (or the plane surface 112).

Like the eighth embodiment, the groove 104 functioning as the insulating portion is formed on the flange 22, to be located radially outward of the open-end peripheral portion of the cavity 24, and to extend in the circumferential direction continuously to thereby surround the cavity 24. The groove 104 includes the shoulder surface 42*a*, 42*b*, the base portion 130 and the smaller groove 132, 132, likewise. The shoulder surface 42 located on the side of the cavity 24 is partially defined by the outer peripheral portion of the bottom wall 26. Thus, the sealing zone 46 at which the cover sheet 14 is sealed to the container body 12 is set to the base portion 130 housed within the groove 104.

There will be described a contact lens container of heart shape more specifically. Referring first to FIGS. 27-38, depicted is a blister package 210 as a contact lens case for a contact lens, by way of one embodiment of the present invention. This blister pack 210 includes a container body 212 and a cover sheet 214 serving as the covering sheet. An ophthalmic lens, namely contact lens 216, and a preserving solution 218 are stored in the container body 212, and the cover sheet 214 is strippably sealed to the container body 212 to seal the contact lens accommodated therein, as well as to enable removal when needed.

More specifically, the container body 212 includes a lens storage portion 220 and a flange portion 222.

The lens storage portion 220 has a generally hollow half-spherical shape overall, with a cavity 224 formed inside. This cavity 224 constitutes a storage space for the preserving solution 218 and the contact lens 216. Here, the bottom inside face 226 of the cavity 224 is of generally concave spherical shape on the one hand, with the opening inside face 228 thereof having variable radius of curvature: r in the circumferential direction, producing an opening peripheral shape which is generally of heart shape in plan view.

More specifically, the bottom inside face 226 of the cavity 224, in a zone extending from the deepest section of the center located on the center axis of the cavity, to a somewhat small depth portion equal to the axial height dimension of the contact lens 216 stored therein, has an inside face with a radius of curvature: rc in vertical section that is greater than the radius of curvature: R of the front face 230 of the contact lens 216. In preferred practice, it is established so as to fulfill the equation: $1.2 \leqq rc/R \leqq 1.6$.

By so doing, with the blister package 210 stored resting in a generally horizontal state, the contact lens 216 stored in the cavity 224 contacts with the front face 230 thereof the deepest portion of the inside face (bottom inside face 226) of the cavity 224 at only a single point on the center axis, whereby the contact lens 216 is held stored in a stable manner in the cavity 224, without being subjected to any unnatural strain resulting from localized pressure on its outer peripheral portion.

Figure 28:
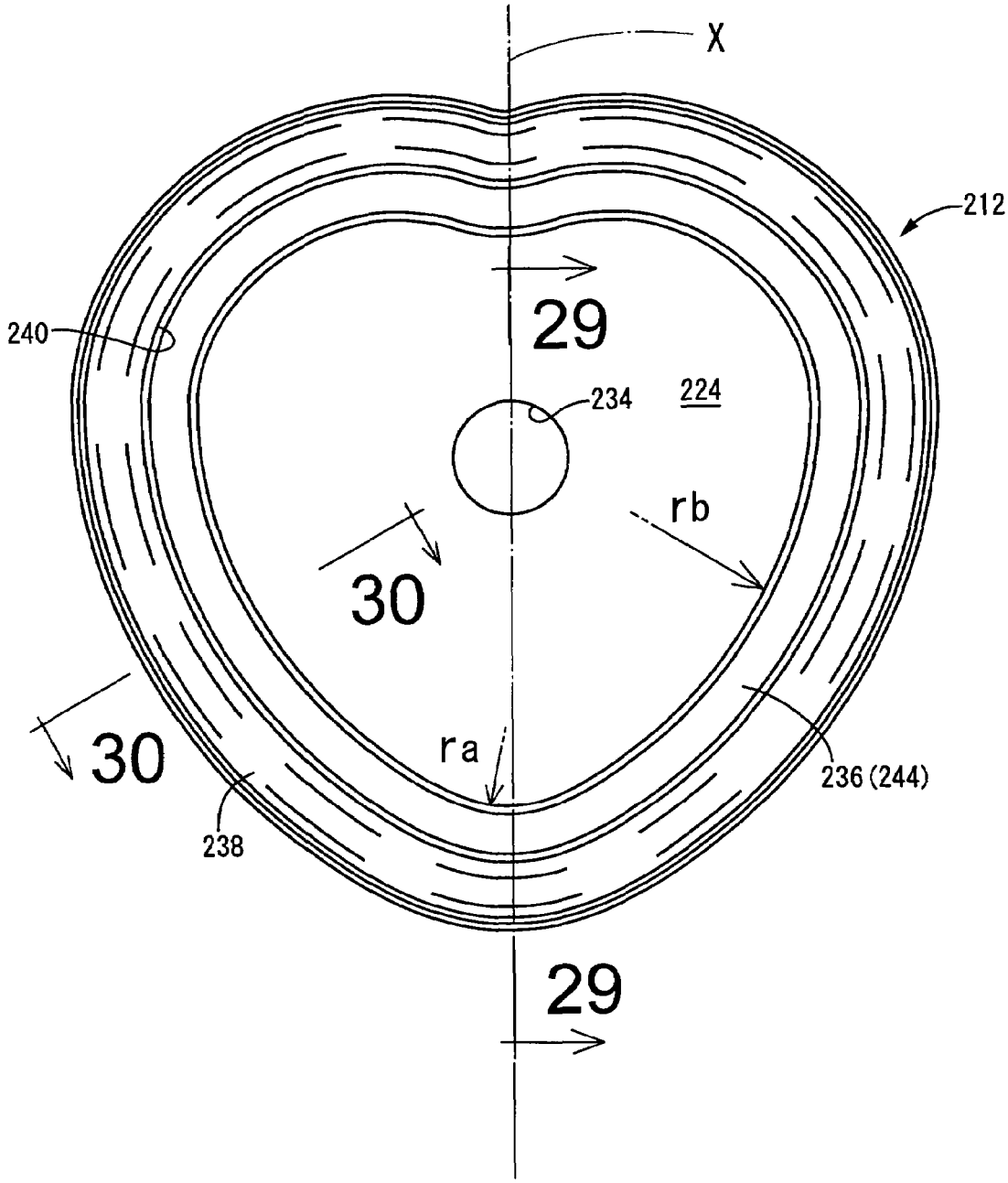
FIG. 28 is a top plane view of the container body of FIG. 27.
Figure 29:
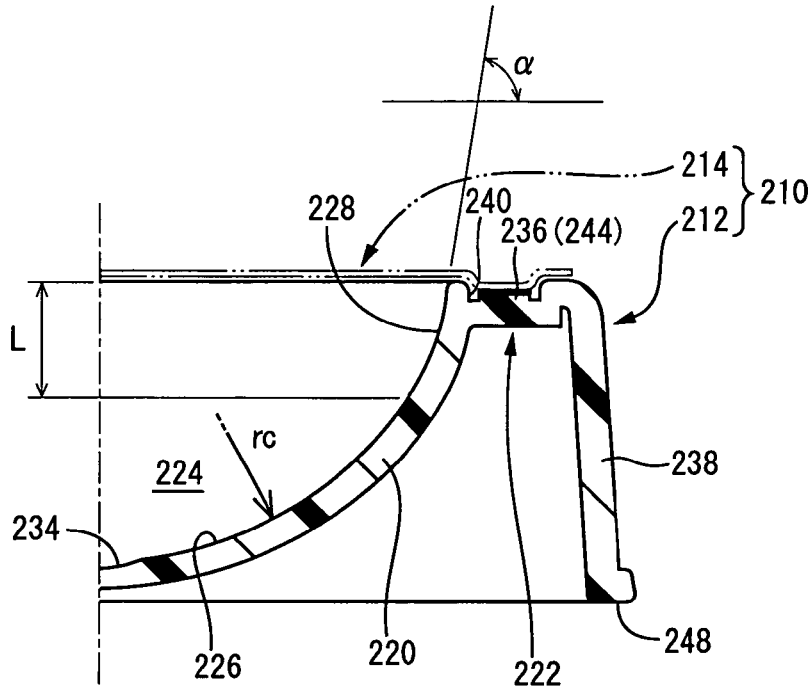
FIG. 29 is a vertical cross sectional view taken along line 29-29 in FIG. 28
Figure 30:
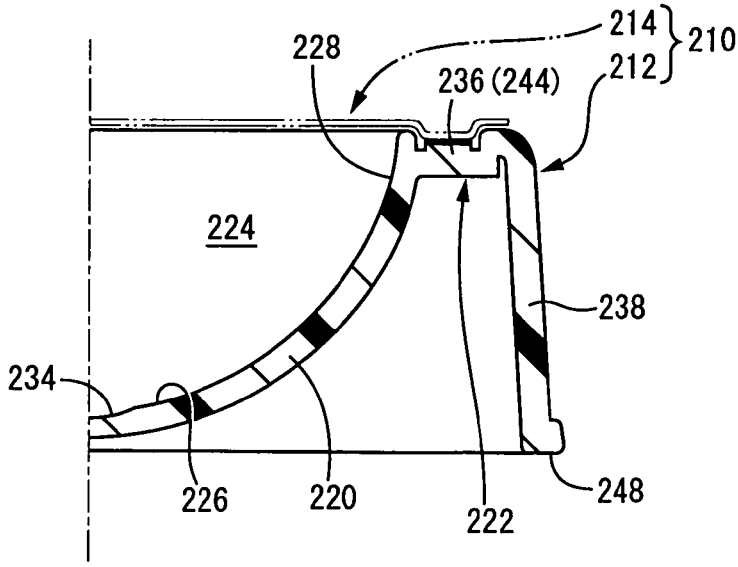
FIG. 30 is a vertical cross sectional view taken along line 30-30 in FIG. 28.

On the other hand, the inside face 228 of the opening peripheral portion (portion situated towards the opening portion side from the bottom portion) of the cavity 224 has a circumferential radius of curvature that varies along the circumference, bowed so as to produce a smooth, generally heart shape overall in plan view (see FIG. 28). That is, it is left-right symmetrical in relation to a centerline: X extending in the vertical direction of FIG. 28, with the bottom end in FIG. 28 constituting the constricted portion at the lower portion of the heart shape, and the left and right sides in FIG. 28 forming a pair of bulging heart-shaped side portions.

In the lower portion of the heart, the circumferential radius of curvature: ra of the inside face is smaller than the radius of curvature: R of the front face 230 of the contact lens 216. In preferred practice, it is established so as to fulfill the equation: $0.2 \leqq ra/R \leqq 0.4$. In the heart-shaped side portions, on the other hand, the circumferential radius of curvature: rb of the inside face is greater than the of curvature: R of the front face of the contact lens 216. In preferred practice, it is established so as to fulfill the equation: $1.2 \leqq rb/R \leqq 2.0$.

Figure 31:
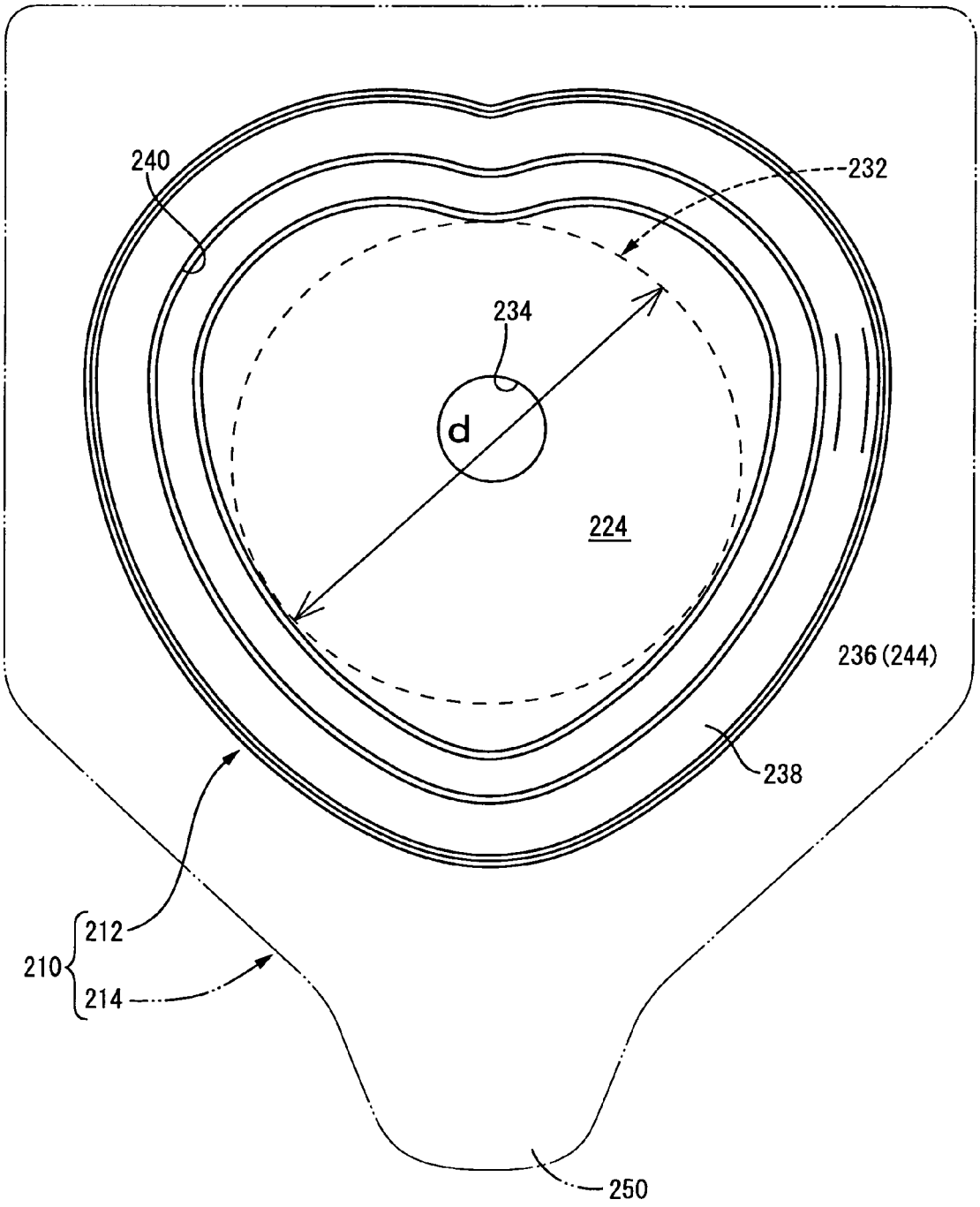
FIG. 31 is a plane view for explaining a shape of a cover sheet in relation to the container body of FIG. 27.

As shown in FIG. 31, the size of the opening of the opening peripheral portion (opening edge portion) of the cavity 224 is established such that the diameter dimension: d of an inscribed circle 232 thereof is greater than the outside diameter dimension: D of the contact lens 216. In preferred practice, it will be established such that $1.2 \leqq d/D \leqq 1.6$. As will be apparent from FIG. 31, in this embodiment, in the opening peripheral portion of cavity 224, the opening peripheral portion of the cavity 224 contacts the inscribed circle 232 at a total of three points, namely, one point at the upper edge of the heart shape, and points in the lower portions of the two sides of the heart shape (or upper portions of the left and right sides of the constricted portion of the lower portion of the heart).

The opening inside face 228 of the cavity, over an area thereof of predetermined depth dimension: L from the opening peripheral portion in the depthwise direction of the cavity, has a slope angle: $\alpha$ of 45° or greater with respect to the horizontal axis in vertical section. The area in which the slope angle: $\alpha$ of the opening inside face 228 of the cavity 224 is 45° or greater may extend around the entire circumference, but at a minimum will be an area in proximity to the predetermined region for draining liquid. In this embodiment, the predetermined region for draining liquid is the constricted portion in the lower end of the heart shape.

As will be described later, in order to more advantageously assure detaining action of the contact lens 216, the aforementioned L value will preferably be set to 2 mm or greater, more preferably such that $L \geqq 5$ mm. Also, the value of $\alpha$, at least in the predetermined region for draining liquid, will preferably be such that $\alpha \leqq 60$, because if it is too large it becomes difficult to drain off the preserving solution.

In the center of the bottom of the cavity 224, there is formed a circular recessed portion 234 situated in the center of the deepest portion (i.e. on the center axis of the bottom inside face 226 of cavity 224). This circular recessed portion 234 has a concave spherical face and opens into the bottom inside face 226 with a diameter dimension that is sufficiently smaller than the outside diameter dimension: D of the contact lens 216. The radius of curvature: rd of the circular recessed portion 234 is smaller than the radius of curvature: R of the front face of the contact lens 216. In preferred practice, the outside diameter dimension: D of the circular recessed portion 234 is established at about $\phi$1.0 mm −5 mm.

Figure 32:
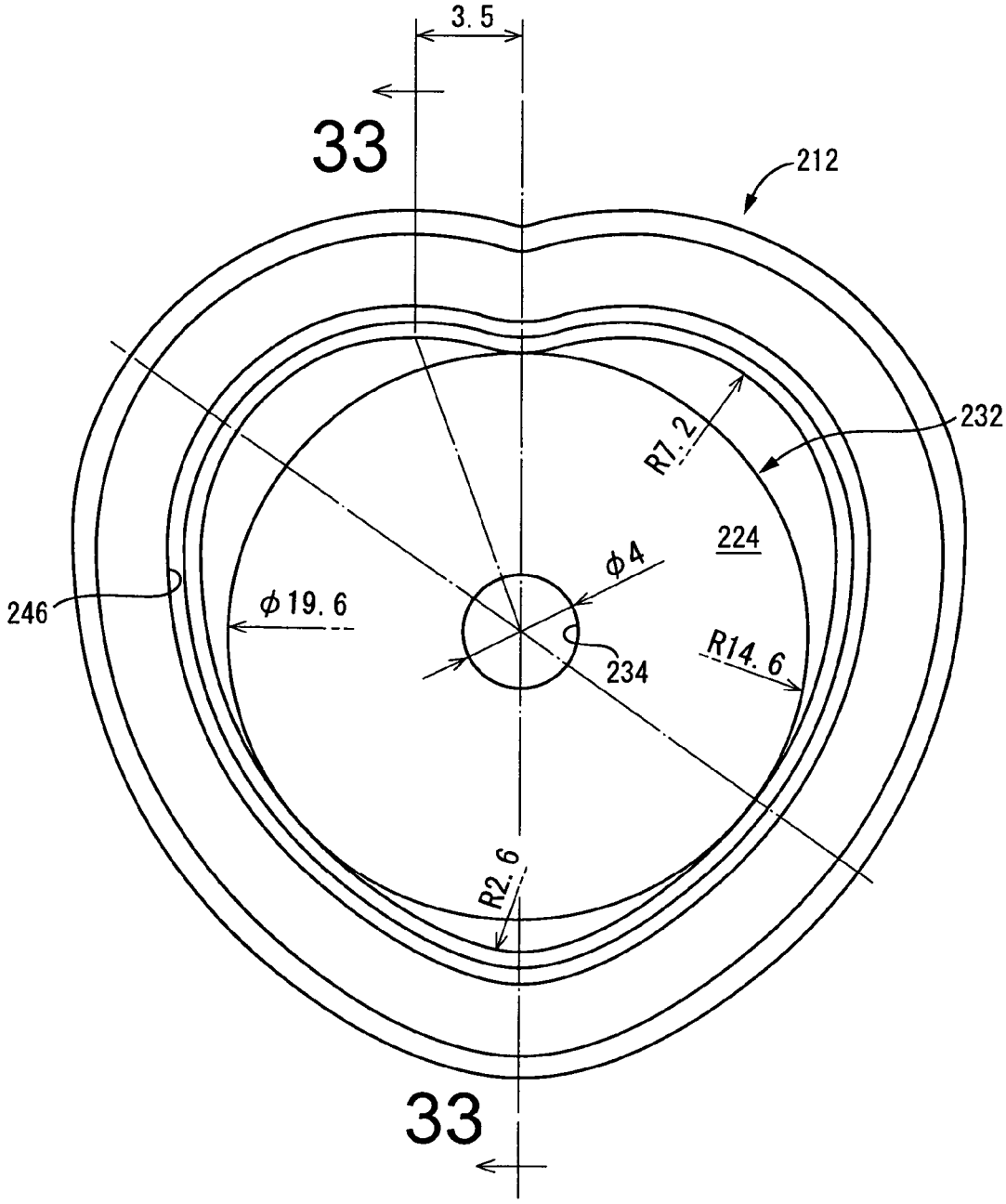
FIG. 32 is a plane view illustrated an example of specific design of the container body shown in FIGS. 27-31.
Figure 33:
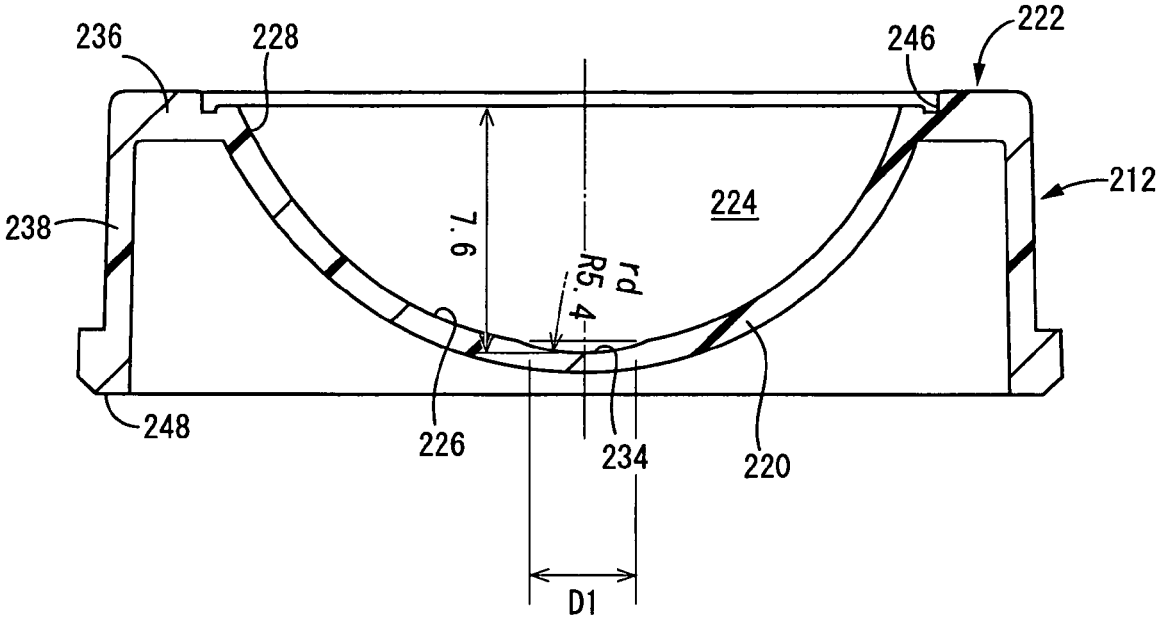
FIG. 33 is a vertical cross sectional view taken along line 33-33 in FIG. 32.
Figure 34:
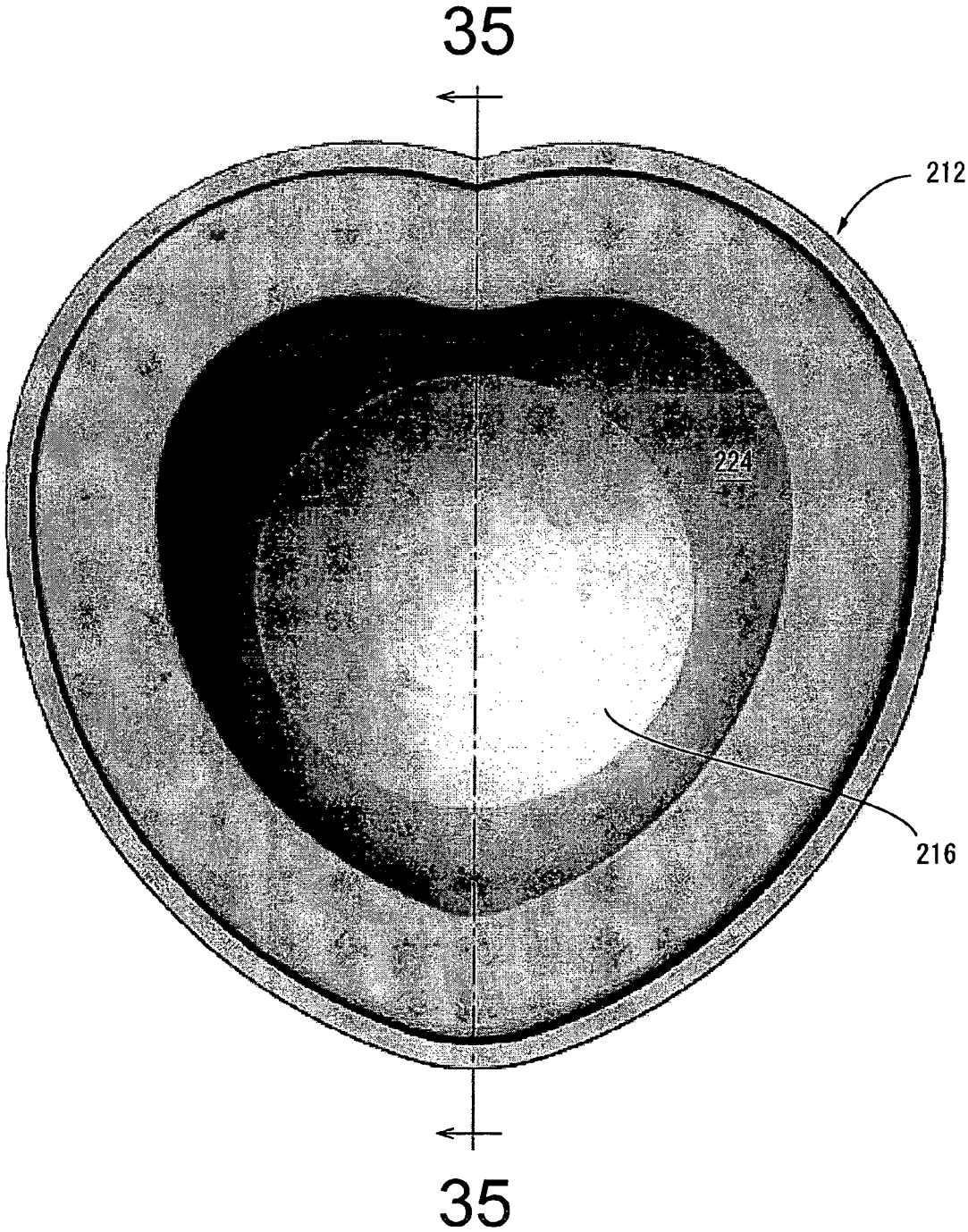
FIG. 34 is a plane view for explaining a state where a contact lens is stored in the container body shown in FIG. 32.
Figure 35:
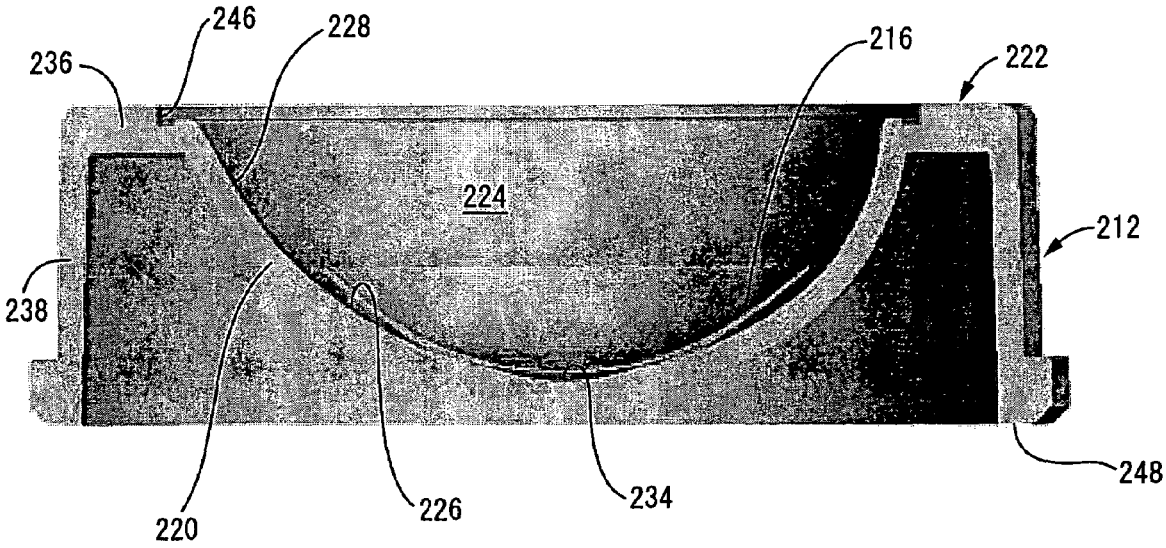
FIG. 35 is a vertical cross sectional view taken along line 35-35 in FIG. 34.

A specific example of the shape of a cavity established in accordance with the conditions given above is shown in FIGS. 32-33. The contact lens 216 is shown stored therein in FIGS. 34-35, by way of reference illustrations. The shape of the container body 12 shown in FIGS. 34-35 is in accordance with the specific design values given in FIGS. 32-33. The contact lens 216 shown stored therein has a radius of curvature at the front face 230 of R=12.5 mm.

On the other hand, the flange portion 222 is composed of a flat portion 236 extending in the direction orthogonal to the center axis of the cavity 224, and a pedestal portion 238 of skirt shape extending downwardly from the outside peripheral edge of the flat portion 236. The inside and outside peripheral edge portions of the flat portion 236 connect via smooth curving faces (bowed faces) to the opening inside face 228 of the cavity 224 and to the pedestal portion 238, respectively.

The blister package 210 shown in FIGS. 27-31 and the structural example shown in FIGS. 32-35 giving a shape of specific exemplary preferred dimensions are modes that differ slightly in relation of the flat portion 236.

Specifically, the flat portion 236 shown in either FIGS. 27-31 and that shown in FIGS. 32-35, are no different in that they are integrally formed extending to the outside peripheral side from the opening peripheral portion of the cavity 224, at a substantially constant dimension around the entire circumference. On the upper face thereof, the cover sheet 214 for covering the cavity 224 in fluid-tight fashion is hermetically sealed.

Here, the blister package 210 shown in FIGS. 27-31 has formed therein a groove-shaped recess 240 extending continuously around the entire circumference in the circumferential direction of the laterally central portion of the flat portion 236. The inside peripheral wall of this groove-shaped recess 240 takes the form of a shoulder face that is spaced apart by a predetermined distance from the opening peripheral portion of the cavity, and that extends bending downward in the direction opposite the cavity opening direction, with an edge cutting portion being formed by this shoulder face.

On the bottom face of the groove-shaped recess 240 there is formed plateau-shaped convex portion 244 shorter than the depth of the groove-shaped recess 240, extending continuously across the entire length. A bonding face for the cover sheet 214 is formed by the flat upper surface of this convex portion 244.

In the blister package 210 shown in FIGS. 27-31, on the other hand, a circumferential recess 246 extends continuously in the circumferential direction around the entire circumference in proximity to the inside peripheral edge of the flat portion 236. The outside peripheral side of the circumferential recess 246 projects upwardly above the inside peripheral side where the opening peripheral portion of the cavity 224 is situated. By so doing, the inside peripheral wall of the circumferential recess 246 forms a first shoulder face that is spaced apart by a predetermined distance from the opening peripheral portion of the cavity 224, and that extends bending downward in the direction opposite the cavity opening direction. The outside peripheral wall of the circumferential recess 246 forms a second shoulder face that is spaced apart by a predetermined distance from the opening peripheral portion of the cavity 224, and that extends bending upward in the same direction as the cavity opening direction. This first shoulder face and second shoulder face respectively form edge cutting portions.

The entire circumference of the outside peripheral side of the circumferential recess 246 constitutes an annular convex portion 248 that projects axially upward to a significant degree. A bonding face for the cover sheet 214 is formed by the flat upper surface of this annular convex portion 248.

The pedestal portion 238 which is formed extending downwardly from the outside peripheral edge of the flat portion 236 has a heart-shaped drum conFIGuration that flares slightly to the outside peripheral side going down from the flat portion 236. The axial length of the pedestal portion 238 is slightly greater than the axial dimension of the lens storage portion 220, so as to cover the lens storage portion 220 in its entirety on the outer peripheral side. The lower peripheral edge of the pedestal portion 238 is reinforced by being made thick around its entire circumference. The lower face of this lower peripheral edge constitutes a support face 248 that extends generally orthogonally to the center axis of the cavity 224, whereby, when this support face 248 is positioned resting on a flat, horizontal surface such as a desktop, the blister package 210 can rest in a stable manner with the cavity 224 open in the vertical direction.

In consideration of fabrication costs, handling, and so on, the container body 212 of the structure described above comprising the container body 212 and the flange portion 222 will preferably employ synthetic resin materials having excellent strength and chemical resistance, in particular, fluororesins, polyamide, polyacrylate, polyethylene, polyethylene terephthalate, polyvinyl chloride, amorphous polyolefins, polycarbonate, polysulfone, polybutylene terephthalate, polypropylene, polymethyl pentene, and the like, composites thereof, or multi-layer structure synthetic resins. The container body 212 is advantageously manufactured by integral molding by means of subjecting such resin materials to injection molding or the like.

Here, the inside face of the cavity 224 of the container body 212 will preferably have an appropriate degree of surface roughness, in order to more advantageously realize the procedure for draining the preserving solution from the cavity 224, described later, or for removing the contact lens 216. Surface roughness of this cavity 224 is advantageously achieved, for example, by imparting a suitable level or surface roughness or surface texture to the cavity 224 molding face of the mold for forming the container body 212. Specifically, this may be achieved by subjecting the forming mold surface to a shot blast laser irradiation, or other process.

The surface texture of the inside face of the cavity 224 established in this manner will preferably have wrinkle-like or pear skin-like irregularities. More specifically, selecting from among the four types and twelve finishes specified in "MOLD FINISH COMPARISONS BASED ON THE SPI" which is a standard for indicating surface conditions of molds (once ascertained, please disclose specifics regarding the entity specifying this standard), one resembling extremely closely a "blast finish sample (DRY BLAST)" will preferably be adopted. More preferably, the valley portions and peak portions of the wrinkle-like or pear skin-like irregularities will have smooth curving surfaces, so as to advantageously avoid damage to the surface of the contact lens 216, as well as to suppress scattering of light when optical inspection or verification is carried out with the contact lens 216 stored therein, so that the procedure may be carried out easily.

In preferred practice, the surface roughness of the cavity 224 over the entirety thereof will be such that that maximum height: Ry value is $Ry \leqq 5$ μm. Alternatively, the surface roughness of the cavity 224 may be surface roughness finer than #800 grade sandpaper. As a result of an examination of levels of surface roughness that would be effective in avoiding excessive attraction of the contact lens 216 while avoiding the problem of damage to the contact lens 216 surface and the problem of scattering of transmitted light, for a number of blister packages 210 manufactured as prototypes by the inventors, it was found that three blister packages 210 (specimens) were especially good, measured values for surface roughness of these being given in Table 1 hereinbelow. The surface roughness texture employed was pear skin-like, which is similar to the "blast finish sample" of the "MOLD FINISH COMPARISONS BASED ON THE SPI" cited above. The contact lenses 216 used for the evaluation were hydrophilic soft contact lenses of HEMA (hydroxyethyl methacrylate) material. Of course, the preferred values given here by way of example should be understood as being variable depending on the material of the container body 212 and the surface condition of the cavity 224, as well as the characteristics of the preserving solution used, the material and shape of the contact lens 216, and so on.

TABLE 1

| Specimen No. | Measuring direction | Mold A | Mold B |
|---|---|---|---|
| NO. 1 | horizontal | 2.6 | 2.5 |
| | vertical | 3.6 | 2.7 |
| NO. 2 | horizontal | 2.3 | 2.0 |
| | vertical | 3.0 | 2.0 |
| NO. 3 | horizontal | 3.0 | 2.3 |
| | vertical | 3.5 | 2.5 |
| average value | | 3.0 | 2.3 |
| standard deviation | | 0.5 | 0.3 |

unit: microns

Where determination of the presence/absence of a contact lens 216 or a pass/fail determination with regard to some defect or characteristic is carried out by means of direct visual observation or an imaging process with rays of light passing through the cavity 224 with a contact lens 216 stored therein, light transmissivity in the cavity 224 forming region of the container body 212 should be evaluated as well. Specifically, in preferred practice, for visible light, which is the type of light employed in such inspections, transmissivity of light in the axial direction (depthwise direction of cavity 224) will be 80% or above.

The aforementioned cover sheet 214, which covers the opening of the cavity 224 with the preserving solution and a contact lens 216 stored therein, is favorably formed from a laminate sheet of a composite material of aluminum foil and synthetic resin or the like. The material is of planar conFIGuration larger than the outside perimeter of the upper face of the container body 212, and is superimposed on the upper face of the container body 212, and sealed to the flat face 236 of the aforementioned flange portion 222 by means of sheet sealing, adhesive, or the like.

The cover sheet 214 seals the preserving solution and the contact lens 216 within the cavity 224; when using the contact lens 216, it is necessary to grip the cover sheet with the fingers and strip it quickly from the container body 212 to open the cavity 224. Here, in this embodiment, there is formed a pull tab 250 that projects outwardly (downward in FIG. 1) from the constricted portion in the lower portion of the heart shape in the cavity 224. By grasping the pull tab 250 with the fingers, the cover sheet can be peeled away from the leading edge portion in the lower portion of the heart, which has the narrowest width dimension of the bonding face.

In a blister package 210 comprising a container body 212 of the structure described above, when a user supplied therewith uses the contact lens 216, when removing the contact lens 216 after first stripping the cover sheet from the container body 212 to open the cavity 224, first, the preserving solution only is drained from the cavity 224. Not only is the contact lens 216 immersed in the cavity 224 difficult to see, but if a finger is inserted into the cavity to lift out the contact lens 216 directly, the preserving solution which substantially fills the cavity 225 may spill out and soil a large surrounding area.

During liquid drainage (draining the preserving solution from the cavity 224), the container body 212 is held in the hand, and inclined so that the constricted portion which is the lower portion of the heart (the lower portion in FIG. 28) drops vertically downward. Upon so doing, the preserving solution collects at the narrow opening of the lower portion of the heart, whereby the preserving solution can be drained from the cavity 224 via a flow passage of narrow width that prevents spreading out in the circumferential direction. Accordingly, spreading of liquid drainage over a wide area can be prevented, making for easy handling.

Figure 36:
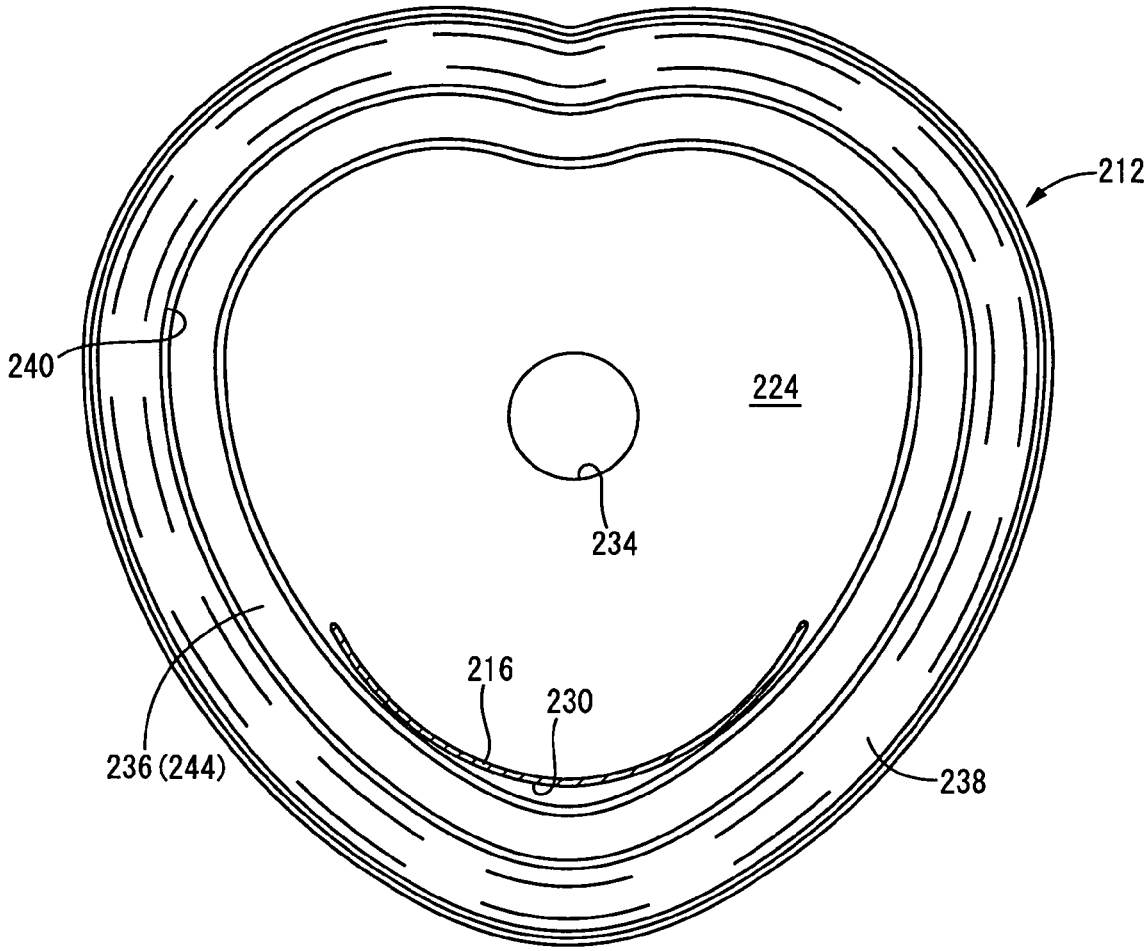
FIG. 36 is a front elevational view showing a state of the contact lens being detained within a cavity during draining a preserving solution from the container body.
Figure 37:
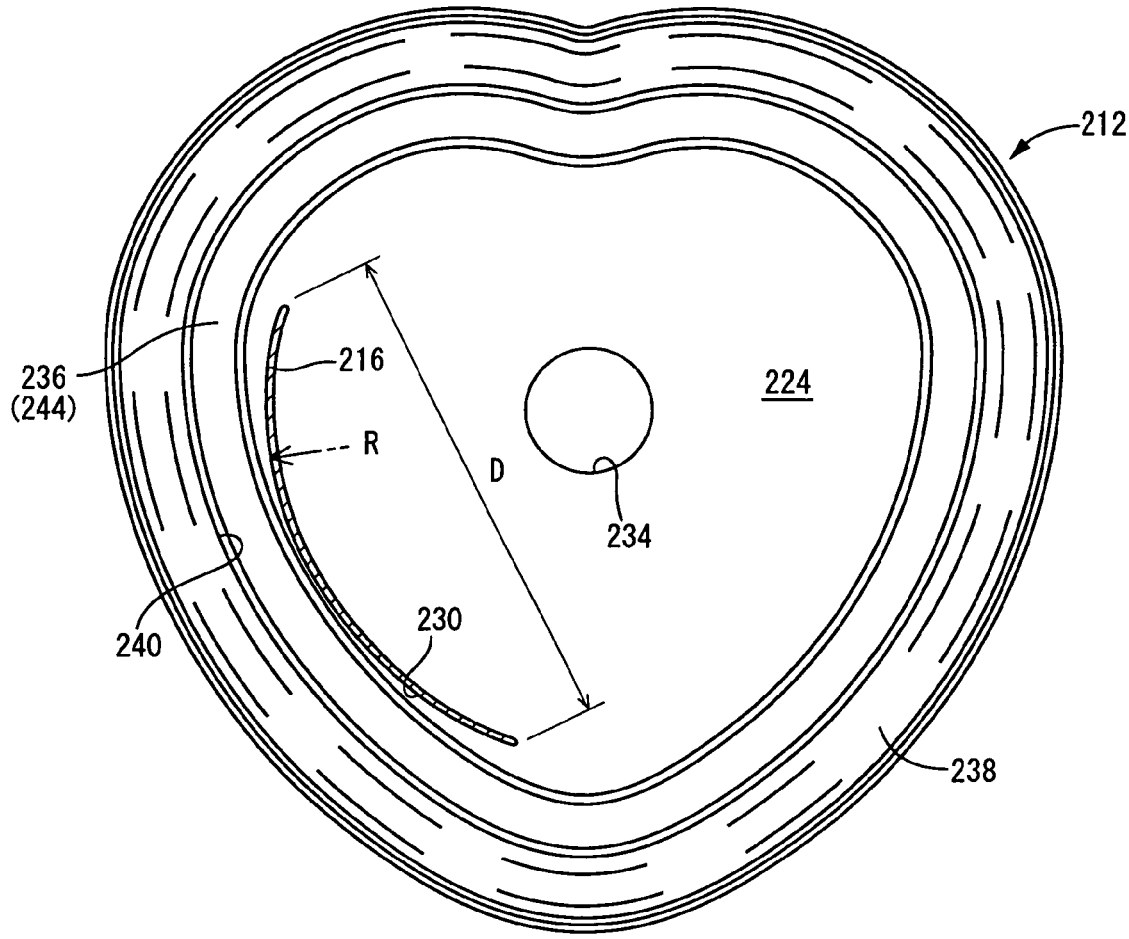
FIG. 37 is a front elevational view showing a state of the contact lens being removed from the container body.

At this time the contact lens 216 which has been soaking in the preserving solution will also attempt to flow out, but since the circumferential radius of curvature of the cavity 224 in the constricted portion of the lower portion of the heart situated vertically below is smaller than the radius of curvature of the front face of the contact lens 216, as shown in FIG. 36, once drawn to the constricted portion of the lower portion of the heart, the front face 230 of the contact lens 216 comes into contact at two points on the circumference with the opening inside face 228 of the cavity 224. As a result, the contact lens 216 comes into abutment with the cavity 224 over a wide area, with the frictional force of this wide area and the surface tension of the preserving solution acting to detain the lens within the cavity 224.

In this embodiment in particular, since the contact lens 216 is of soft type, as shown in FIG. 36, the action of surface tension of the preserving solution present between the front face of the contact lens 216 and the opening inside face 228 of the cavity 224 leads to the contact lens 216 coming into contact over a wide abutting portion with the opening inside face 228, and the contact lens 216 becomes wedged into the lower portion of the heart and undergoes deformation into a shape pinched from either side in the circumferential direction so that the radius of curvature in the center portion of the lens increases, thereby providing an even higher level of detaining force.

Figure 38:
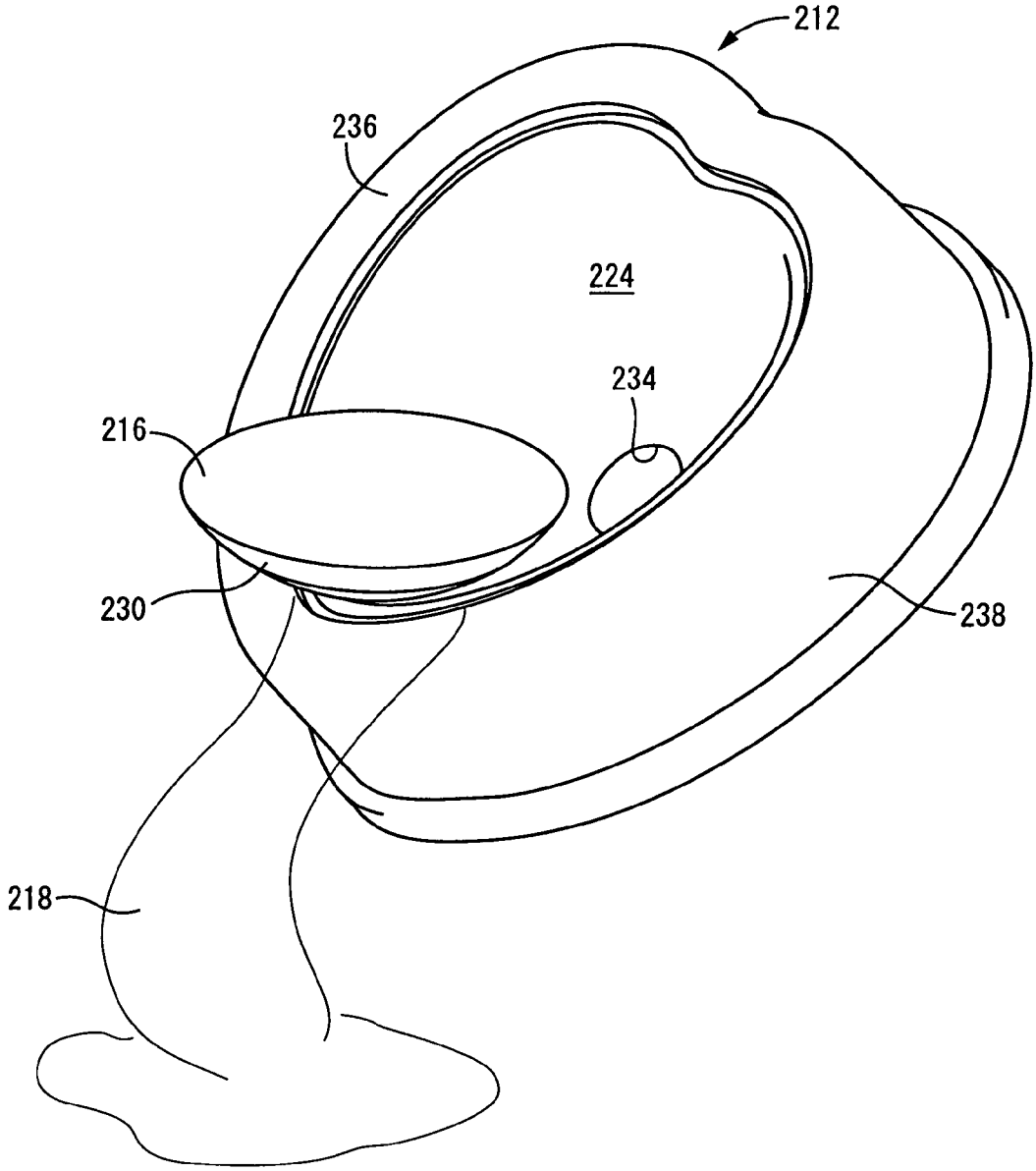
FIG. 38 is a perspective view showing the container body being tilted to drain the preserving solution.

Thus, as shown in the illustration of FIG. 38, the operation of draining only the extra preserving solution from the cavity 224 with the contact lens 216 still retained within the cavity 224 can be carried out quickly and easily without the use of any special utensils, by means of the simple operation of tilting the container body 212 while holding it in the hand.

Additionally, as shown in FIG. 38, during draining of the preserving solution the contact lens 216, together with the preserving solution, is conducted to the opening of the constricted portion in the lower portion of the heart, and is held detained there with a portion thereof projecting outward beyond the opening. Thus, in a state after the liquid has been drained, the contact lens 216 may be grasped with the fingers from the portion thereof projecting outward from the cavity 224, and can be removed very easily. Accordingly, the container body 212 described hereinabove offers significant improvement not only in ease of the draining procedure, but in ease of procedure when picking up the contact lens 216 as well.

With the contact lens 216 partially projecting out from the cavity 224 in this way, in order to grasp the contact lens 216 so as to remove it, as compared to the case of the removal operation often encountered with blister packages of conventional design, wherein the container body 212 is held on the horizontal while inserting the fingers into the cavity 224, and the contact lens 216 in the preserving solution is pressed, and the contact lens 216 then slid over the inside face of the cavity 224 and removed from the opening peripheral portion of the cavity 224, there is no abrasion of the contact lens 216 by the inside face of the cavity 224, whereby the problem of damage to the contact lens 216 is advantageously avoided.

Further, in this embodiment, in the circumferential sides of the constricted portion in the lower portion of the heart, with which the contact lens 216 comes into abutment at least during liquid drainage, the slope angle: $\alpha$ of the opening inside face 228 of the cavity 224 is approximately 45°. Thus, even if the container body 212 is inclined by up to 45°, the opening inside face 228 of the cavity 224 will be maintained in a generally horizontal attitude, at least in proximity to the opening peripheral portion. Thus, the contact lens 216 may be prevented from falling out of the cavity 224 due to gravity, so that outflow of the contact lens 216 can be achieved even more effectively.

In this embodiment, a circular recessed portion 234 is formed situated in the center of the deepest portion of cavity 224, with the inside face of this circular recessed portion 234 situated a predetermined distance away from the front face 230 of the contact lens 216, whereby with the blister package 210 being transported or stored while disposed on the horizontal, the contact lens 216 is supported at a single point at its center through abutment with the inside face of the cavity 224 may be avoided. By so doing, the force of contact of the cavity 224 inside face against the contact lens 216 can be distributed so as to reduce localized stress, and in particular the force of contact can be distributed evenly and efficiently by means of abutment in a circular conFIGuration. As a result, strain and deformation of the contact lens 216 can be advantageously prevented, and the effect of preventing attraction of the lens onto the cavity 224 inside face can be achieved. Since the inside face of the circular recessed portion 234 does not come into contact with the contact lens 216, it is not necessary to impart surface roughness of the inside face of the circular recessed portion 234.

Further, in this embodiment, the sealing face of the cover sheet 214 against the container body 212 is situated away to the outside peripheral side from the opening peripheral portion of the cavity 224, and is additionally positioned via a cutting edge portion of shoulder conFIGuration with respect to the opening peripheral portion of the cavity 224, whereby even if burring or the like should occur during stripping of the cover sheet 214, interference with the contact lens 216 by this burring when the contact lens 216 is removed from the cavity 224 is effectively prevented. With this arrangement, the procedure for removing the contact lens 216 from the cavity 224 can be made even easier, and damage to the contact lens 16 caused by contact with burrs or the like can be avoided.

In the embodiments shown in FIGS. 27-38 hereinabove, a circular recessed portion 234 is formed in the center of the inside face of the cavity 224, but this circular recessed portion 234 need not necessarily be provided.

Figure 39:
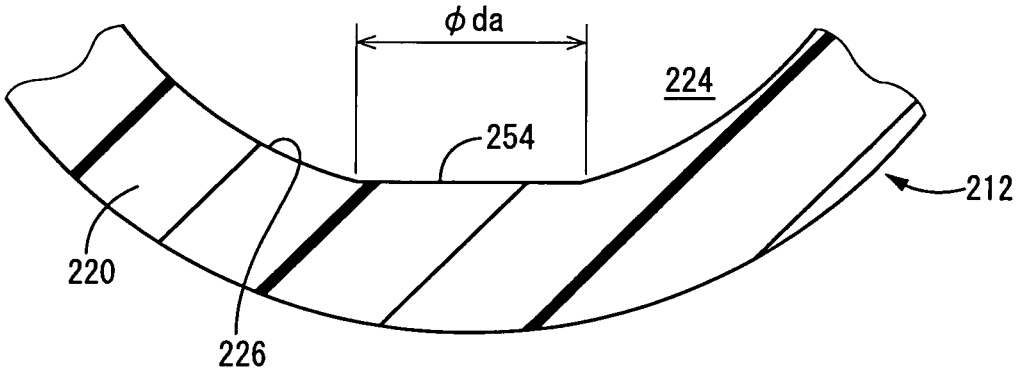
FIG. 39 is an enlarged cross sectional view showing a specific design of a bottom inside face suitable for use in the container body of FIG. 27.

Instead of the circular recessed portion 234, there could be provided a circular flat portion 254 extending orthogonally with respect to the center axis of the cavity 224, as shown in enlarged vertical section in FIG. 39, for example. By forming this circular flat portion 254, the contact lens 216 may readily be induced to undergo displacement in the axis-perpendicular direction on the circular flat portion 254, by means of inputting a slight external force.

As a result, it is possible to easily avoid a situation where, for example, the contact lens 216 is in continuous contact with a particular location on the inside face of the cavity 224. Also, when conducting inspection or verification of a contact lens 216 in the stored state by means of light as described above, it is possible to induce displacement of the contact lens 216 within the cavity 224 so that the contact lens 16, which can be difficult to discern, can be discerned reliably by means of its edge or the like. From the standpoint of this objective, the circular flat portion 254 will preferably have an outside diameter dimension $\phi da$=1 mm −5 mm.

In the embodiments hereinabove, the working effects of the invention were described taking the example of removing a contact lens 216 at the time of use, but similar working effects would be afforded also, for example, in the manufacturing process of a blister package 210 in which the contact lens 216 and a preserving solution are sealed within a blister package 210. Specifically, in such a manufacturing process for example, in some instances, prior to sealing in the contact lens 216 and the preserving solution, a cleaning solution or other process solution is placed in the cavity 224 in order to clean or otherwise treat the contact lens 216. When subsequently draining off the process solution and injecting the preserving solution, where a container body 212 with the structure according to the invention is employed, the process solution can be drained off while keeping the contact lens 216 inside the cavity 224, without the use of any special utensils, thereby effectively providing greater ease in manufacture of the blister package 210.

In a blister package 210 having a heart-shaped container body 212 as described above, as well as a flange portion 222 whose outside peripheral shape is also heart-shaped, multiple units can be packed into a storage box, and efficiently transported, warehoused, or delivered with excellent efficiency.

Specifically, in the interior of a storage box, by arranging the blister packages 210 with the heart-shaped left and right side portions of separate blister packages adjacent to one another and with adjacent blister packages 210 opposed to one another vertically, in order to line up a plurality of contact lens containers in the left-right direction, it becomes possible to advantageously provide a package product storing a plurality of blister packages 210. In such a package product, a morphological feature, namely the constricted width of the lower portion of the heart, is utilized skillfully to be able to efficiently store a plurality of blister packages 210 in a small storage box.

Figure 40:
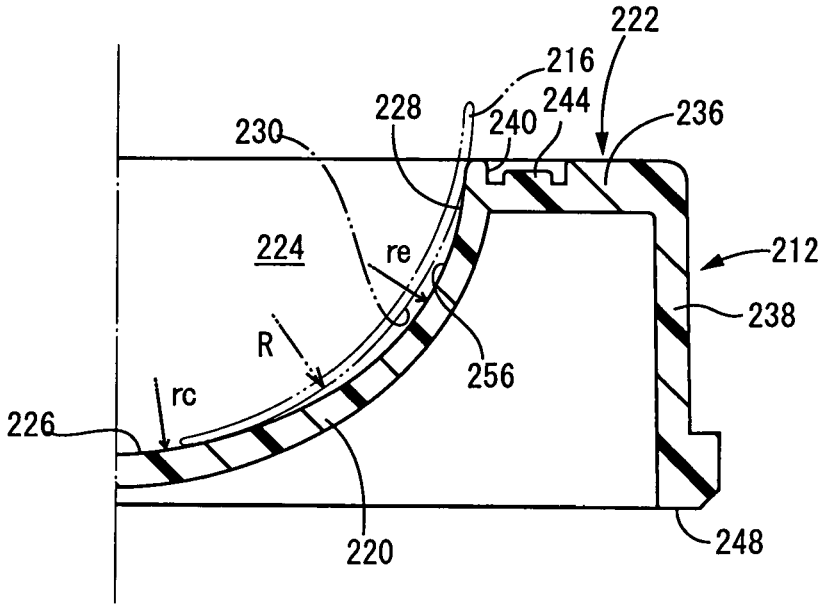
FIG. 40 is a perspective view of a container body of a blister package according to another embodiment of the present invention.
Figure 41:
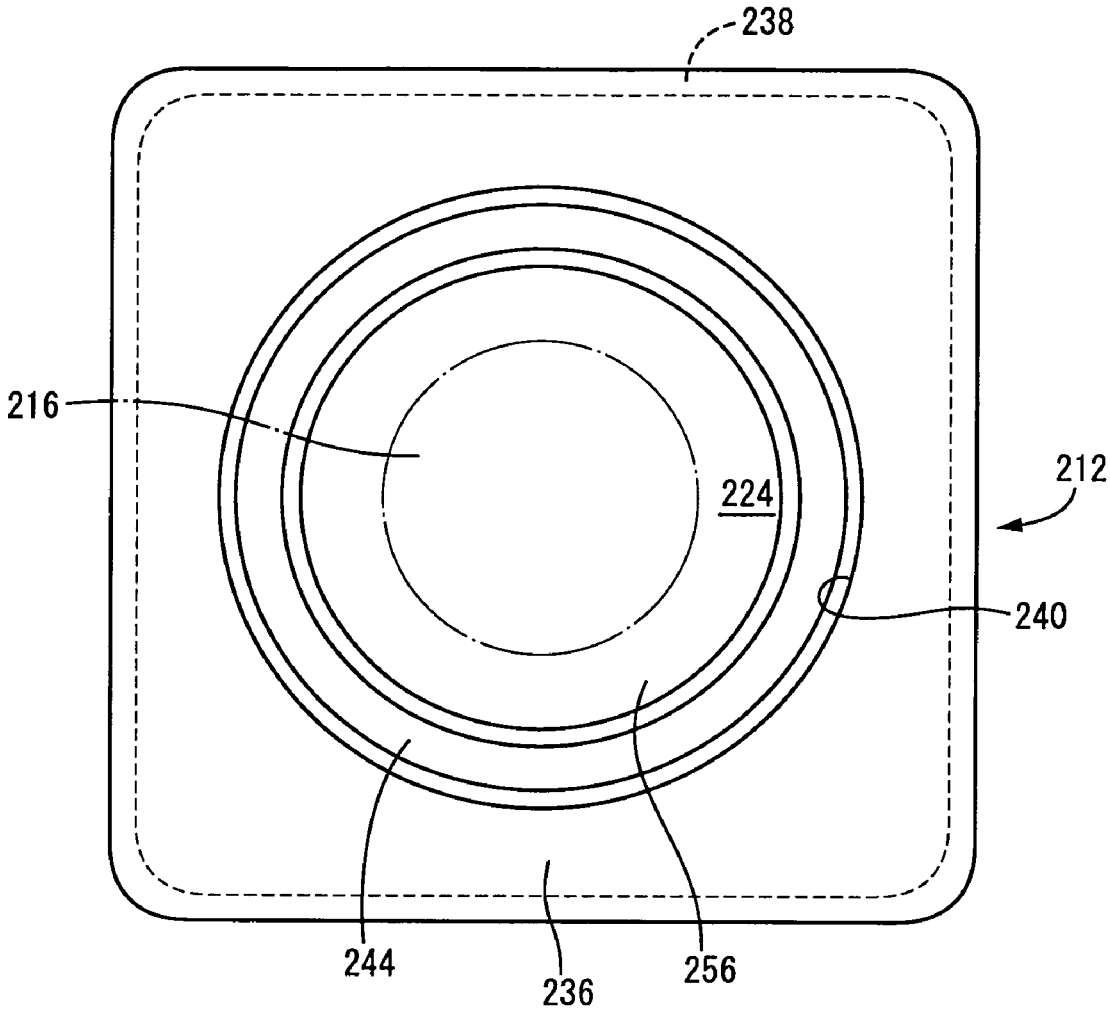
FIG. 41 is a top plane view of the container body of FIG. 41.

FIG. 40 shows a container body 212 making up a blister package in another embodiment of the invention. To aid in understanding, members and regions having the same structure as in FIGS. 27-35 have been assigned identical symbols in the drawing.

With this container body 212, in the opening inside face 228 of the cavity 224, there is provided an area whose radius of curvature: re value in the circumferential direction in vertical section thereof is smaller than the radius of curvature: R of the front face 230 of the contact lens 16. An upright curving portion 256 is formed by this area.

In preferred practice, the upright curving portion 256 located to the opening side of the bottom inside face 226 of the cavity 224 has a radius of curvature: re that fulfills the following equation.

$$0.5 \leqq re/R \leqq 0.9$$

That is, when a container body 212 having a cavity 224 comprising the opening inside face 228 is tilted in order to drain off the preserving solution, as shown in FIG. 42, in the diametrical direction shown in the vertical section, the front face 230 of the contact lens 216 comes into abutment at two points with the inside face of the cavity 224. As a result, as in the embodiments depicted in FIGS. 27-35, frictional force of the contact lens 216 against the inside face of the cavity 224 and the surface tension of the preserving solution will effectively produce detaining action of the contact lens 216, so that the contact lens 216 may effectively be prevented from being carried out from the cavity 224 when the cavity 224 is being drained.

The cavity 224 of the container body 212 comprising such an upright curving portion 256 may be provided with a heart-shaped opening peripheral portion like that described above, but is not limited thereto. It would instead be possible for the cavity 224 to be provided with a circular opening peripheral portion which is axially symmetrical about the center axis.

In an article having the heart-shaped opening peripheral portion shown in FIGS. 27-35, where the upright curving portion 256 is formed in the circumferential side portions of the constricted portion of the lower portion of the heart, during draining in the manner shown in FIG. 38, it becomes possible for the contact lens 216 to come into abutment with the inside face of the cavity 224 at two points in the diametrical direction in addition to two points in the circumferential direction. By so doing, it is possible to more effectively prevent the contact lens 216 from being carried out of the cavity 224.

While the embodiments of the invention have been described in detail hereinabove, these are merely exemplary, and the invention is not limited in any way to the specific disclosure of the embodiments herein.

For example, the specific shape, structure, or size of the flange portion of the container body 212 could be modified appropriately for considerations such as ease of use or of forming.

The blister package according to the invention can of course be used for soft contact lenses, including disposable types, of various kinds for nearsightedness, farsightedness, or presbyopia, as well as various other kinds of ophthalmic lenses such as hard contact lenses and intraocular lenses.

The blister package according to the invention can be employed as an ophthalmic lens container for supply to the consumer or other end user, or as an ophthalmic lens container for supply from the manufacturer to medical facilities and the like.

For instance, the container body may be provided with an upright peripheral wall or rib for the purpose of reinforcement, a hole or a cutout for assisting the user in lifting up the cover sheet from the flange or for reducing or balancing the weight of the container body, and an irregular surface for ensuring a non-slip grip of the container body by the user. The shape of the container body is not limited to the illustrated embodiment, but may have a variety of shapes.

The flange of the container body may be desirably shaped to be suitable in use and in packing the contact lens in the blister package, but not be limited to the illustrated ones.

While no detail description is provided for each case, it is also to be understood that the present invention may be embodied with various other changes, modifications and improvements, which may occur to those skilled in the art, without departing from the spirit and scope of the invention defined in the following claims.

As will be understood from the foregoing description, the container body may be provided with an upright peripheral wall or rib for the purpose of reinforcement, a hole or a cutout for assisting the user in lifting up the cover sheet from the flange or for reducing or balancing the weight of the container body, and an irregular surface for ensuring a non-slip grip of the container body by the user. The shape of the container body is not limited to the illustrated embodiment, but may have a variety of shapes.

What is claimed is:

1. An ophthalmic lens container comprising:

a container body including a lens storage portion having a cavity for storing an ophthalmic lens and a preserving solution, and a flange extending radially outwardly around an opening peripheral portion of the cavity and integrally formed with the lens storage portion; and a covering sheet superposed on the container body for covering an opening of the cavity, the covering sheet being strippably sealed around the entire circumference of the opening of the cavity to provide liquid tight closure to the lens storage portion, wherein a bottom inside face of the cavity is of generally concave spherical shape, with a radius of curvature rc in a diametrical direction along a vertical plane of the cavity that is greater than a radius of curvature R of a front face of the ophthalmic lens, wherein at least a portion on a circumference on an inside face of the opening of the cavity has at least one upright curving portion, with a radius of curvature re in the diametrical direction along the vertical plane that is smaller than the radius of curvature R of the front face of the ophthalmic lens, wherein a radius of curvature in the circumferential direction of the inside face of the opening of the cavity varies along the circumferential direction, giving the opening inside face of the cavity a planar shape generally resembling a heart shape, wherein the heart shape includes a constricted portion in the opening inside face of the cavity, with a radius of curvature ra of the constricted portion in the circumferential direction that is smaller than the radius of curvature R of the front face of the ophthalmic lens, wherein the heart shape includes two opposing side portions in the opening inside face of the cavity, with a radius of curvature rb of each of the two opposing side portions in the circumferential direction that is greater than the radius of curvature R of the front face of the ophthalmic lens, wherein a diameter dimension of an inscribed circle in the opening of the cavity is greater than the outside diameter dimension of the ophthalmic lens, and wherein two upright curving portions are provided at opposing portions in the inside face of the opening of the cavity, with the constricted portion of the heart shape interposed therebetween.

2. An ophthalmic lens container according to claim 1, wherein the circumferential radius of curvature ra of the constricted portion of the cavity and the radius of curvature R of the front face of the ophthalmic lens satisfy the following equation:

$$0.2 \leqq ra/R \leqq 0.4.$$

3. An ophthalmic lens container according to claim 1, wherein the circumferential radius of curvature rb of the two opposing side portions of the heart shape in the opening peripheral portion of the cavity and the radius of curvature R of the front face of the ophthalmic lens satisfy the following equation:

$$1.2 \leqq rb/R \leqq 2.0.$$

4. An ophthalmic lens container according to claim 1, wherein a diametrical radius of curvature rc of the bottom inside face of the cavity along the vertical plane and the radius of curvature R of the front face of the ophthalmic lens satisfy the following equation:

$$1.2 \leqq rc/R \leqq 1.6.$$

5. An ophthalmic lens container according to claim 1, wherein the covering sheet has a pull tab extending further outwardly from the portion fixed to the flange portion, at the constricted portion of the heart shape in the opening peripheral portion of the cavity, the pull tab being gripped in order to strip the covering sheet from the flange portion.

6. An ophthalmic lens container according to claim 1, wherein at least a portion in a circumferential direction of the opening peripheral portion of the cavity, over a zone of at least 2 mm in the depth direction from an opening peripheral portion of the cavity, has a sloping face having a slope angle of 45° or more with respect to a plane orthogonal to a center axis of the cavity along the vertical plane.

7. An ophthalmic lens container according to claim 1, wherein a circular recessed portion having a radius of curvature smaller than a radius of curvature of the ophthalmic lens is formed at a location in an approximate center of the bottom inside face situated at the deepest portion of the cavity, the circular recessed portion opening into the bottom inside face of the cavity via an opening diameter of 1 mm-5 mm.

8. An ophthalmic lens container according to claim 1, wherein a generally plane, circular flat portion extending in an axis-perpendicular direction by an outside diameter dimension of 1 mm-3 mm is formed at a location in an approximate center of the bottom inside face located in the deepest portion of the cavity.

9. An ophthalmic lens container according to claim 2, wherein a surface roughness of the inside face of the cavity has a maximum height Ry≦5 μm.

10. An ophthalmic lens container according to claim 1, wherein the inside face of the cavity has a surface roughness finer than 800 grid sandpaper.

11. An ophthalmic lens container according to claim 1, wherein the container body is composed of a transparent resin material having visible light transmissivity of 80% or more in the axial direction of the cavity in the lens storage portion.

12. An ophthalmic lens container according to claim 1, wherein the radius or curvature R of the ophthalmic lens is 12.5 mm.

13. An ophthalmic lens container comprising:

a container body including a lens storage portion having a cavity for storing an ophthalmic lens and a preserving solution, and a flange extending radially outwardly around an opening peripheral portion of the cavity and integrally formed with the lens storage portion; and a covering sheet superposed on the container body for covering an opening of the cavity, the covering sheet being strippably sealed around the entire circumference of the opening of the cavity to provide liquid tight closure to the lens storage portion, wherein a bottom inside face of the cavity is of generally concave spherical shape, with a radius of curvature rc in a diametrical direction along a vertical plane of the cavity that is greater than a radius of curvature R of a front face of the ophthalmic lens, wherein a radius of curvature in a circumferential direction of an inside face of the opening of the cavity varies along the circumferential direction, giving the opening inside face of the cavity a planar shape generally resembling a heart shape, wherein the heart shape includes a constricted portion in the opening inside face of the cavity, with a radius of curvature ra of the constricted portion in the circumferential direction that is smaller than the radius of curvature R of the front face of the ophthalmic lens, wherein the heart shape includes two opposing side portions in the opening inside face of the cavity, with a radius of curvature rb of each of the two opposing side portions in the circumferential direction that is greater than the radius of curvature R of the front face of the ophthalmic lens, wherein a diameter dimension of an inscribed circle in the opening of the cavity is greater than the outside diameter dimension of the ophthalmic lens, wherein in the flange portion, at a location spaced apart by a predetermined distance radially outwardly from the opening peripheral portion of the cavity, a shoulder face that extends bending upward in a same direction as an opening direction of the cavity or axially downward in a direction opposite the opening direction of the cavity is formed continuously around an entire circumference in the circumferential direction to constitute an edge cutting portion, and wherein a sealing face of the covering sheet is disposed at a location to an outer peripheral side of the edge cutting portion.

14. An ophthalmic lens container according to claim 13, wherein the radius or curvature R of the ophthalmic lens is 12.5 mm.

* * * * *